US010884373B2

(12) United States Patent
Takeuchi

(10) Patent No.: US 10,884,373 B2
(45) Date of Patent: Jan. 5, 2021

(54) IMAGE FORMING APPARATUS

(71) Applicant: CANON KABUSHIKI KAISHA, Tokyo (JP)

(72) Inventor: Masaaki Takeuchi, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/857,217

(22) Filed: Apr. 24, 2020

(65) Prior Publication Data

US 2020/0356045 A1 Nov. 12, 2020

(30) Foreign Application Priority Data

May 7, 2019 (JP) ..... 2019-087733

(51) Int. Cl.
*G03G 15/00* (2006.01)
*G03G 21/16* (2006.01)
*G03G 21/18* (2006.01)

(52) U.S. Cl.
CPC ..... *G03G 21/1676* (2013.01); *G03G 21/18* (2013.01); *G03G 2221/163* (2013.01); *G03G 2221/1606* (2013.01)

(58) Field of Classification Search
CPC ..... G03G 21/1676; G03G 21/18; G03G 21/1821; G03G 2215/1654; G03G 2215/1864
USPC ..... 399/107, 108, 110, 111, 113, 114
See application file for complete search history.

(56) References Cited

U.S. PATENT DOCUMENTS

| | | | | |
|---|---|---|---|---|
| 7,415,223 | B2 * | 8/2008 | Sato | G03G 21/1835 399/110 |
| 8,478,161 | B2 | 7/2013 | Numata et al. | |
| 9,588,484 | B2 | 3/2017 | Sato | |
| 9,851,686 | B2 | 12/2017 | Sato | |
| 2018/0088523 | A1 | 3/2018 | Sato | |
| 2019/0163117 | A1 | 5/2019 | Sato | |
| 2020/0041952 | A1 | 2/2020 | Sato | |

FOREIGN PATENT DOCUMENTS

| | | | |
|---|---|---|---|
| JP | 2007-156166 | A | 6/2007 |
| JP | 2011-095538 | A | 5/2011 |
| JP | 2016-138994 | A | 8/2016 |

* cited by examiner

*Primary Examiner* — Hoan H Tran
(74) *Attorney, Agent, or Firm* — Venable LLP

(57) ABSTRACT

An image forming apparatus includes a drum cartridge including a photosensitive drum, a developing cartridge including a developing roller, a main assembly. The main assembly includes a first opening, a second opening, a first openable member, a second openable member, a pressing member, a first pressing releasing member for releasing the developing cartridge from the pressing member in a state in which the second openable member is in a second closed position, in interrelation with movement of the first openable member from a first closed position to a first open position, and a second pressing releasing member for releasing the pressing the developing cartridge from the pressing member in interrelation of movement of the second openable member from a second closed position to a second open position.

3 Claims, 12 Drawing Sheets

IMAGE FORMING APPARATUS

FIELD OF THE INVENTION AND RELATED ART

The present invention relates to an image forming apparatus such as a copying machine or a printer.

As the image forming apparatus, an image forming apparatus in which a drum cartridge including a photosensitive drum and a developing cartridge including a developing roller are mountable in and dismountable from an apparatus main assembly has been known. In this constitution, a cartridge mounted in the apparatus main assembly by guiding a positioning shaft, provided outside the developing cartridge, to a guiding portion provided in the apparatus main assembly has been known. In Japanese Laid-Open Patent Application (JP-A) 2016-138994, pressing of a developing (roller) pressing member pressing the developing roller of the developing cartridge so as to contact the photosensitive drum of the drum cartridge can be released.

In JP-A 2016-138994, release of the pressing of the developing pressing member for separating the developing roller of the developing cartridge from the photosensitive drum of the drum cartridge is performed by opening a first cover to be used when the developing cartridge is mountable in and dismountable from the apparatus main assembly. Mounting and dismounting of the drum cartridge is performed by opening a second cover. At this time, in the case where the mounting and dismounting of the drum cartridge is performed in a state in which the photosensitive drum of the drum cartridge contacts the developing roller of the developing cartridge, there is a liability that deterioration of the developing roller is caused by rubbing of the developing roller with the photosensitive drum.

For this reason, in JP-A 2016-138994, when the first cover used when the developing cartridge is mountable in and dismountable from the apparatus main assembly is in a closed state, the second cover for making access to the drum cartridge is in a locked state so as not to be opened. By this, in a state in which the photosensitive drum of the drum cartridge contacts the developing roller of the developing cartridge, mounting and dismounting of the drum cartridge cannot be performed. That is, in JP-A 2016-138994, in order to pull out the drum cartridge, the drum cartridge cannot be pulled out until a procedure such that the second cover is opened after the first cover is opened is performed.

However, in JP-A 2016-138994, when only the drum cartridge is taken out, there is a need to open not only the first cover but also the second cover, so that it has been desired that operativity is improved.

SUMMARY OF THE INVENTION

According to an aspect of the present invention, there is provided an image forming apparatus comprising: a drum cartridge including a photosensitive drum; a developing cartridge including a developing roller configured to supply toner to the photosensitive drum; and a main assembly configured so that the drum cartridge and the developing cartridge are independently mountable in and dismountable from the main assembly, the main assembly including, a first opening through which the drum cartridge passes when the drum cartridge is mounted in and dismounted from the main assembly, a second opening through which the developing cartridge passes when the developing cartridge is mounted in and dismounted from the main assembly, a first openable member configured to move between a first closed position where the first opening is closed and a first open position where the first opening is open, a second openable member configured to move between a second closed position where the second opening is closed and a second open position where the second opening is open, a pressing member configured to press the developing cartridge so that the developing roller contacts the photosensitive drum, a first pressing releasing member configured to release the developing cartridge from the pressing member in a state in which the second openable member is in the second closed position, in interrelation with movement of the first openable member from the first closed position to the first open position, and a second pressing releasing member configured to release the developing cartridge from the pressing member in interrelation of movement of the second openable member from the second closed position to the second open position.

Further features of the present invention will become apparent from the following description of exemplary embodiments with reference to the attached drawings.

DESCRIPTION OF EMBODIMENTS

An embodiment of an image forming apparatus according to the present invention will be described with reference to the drawings.

<Image Forming Apparatus>

Figure 1:
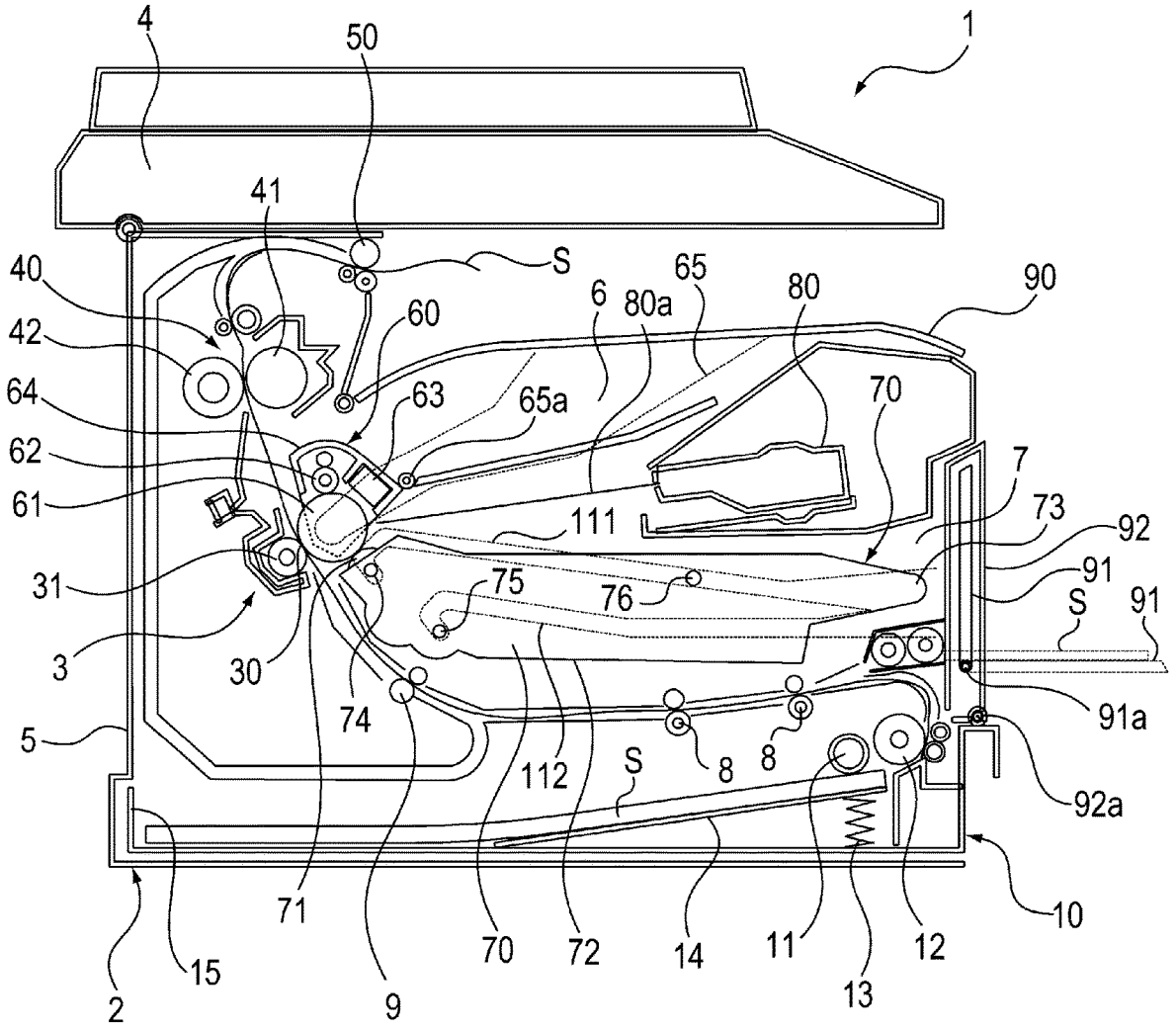
FIG. 1 is a sectional view showing a structure of an image forming apparatus.
Figure 2:
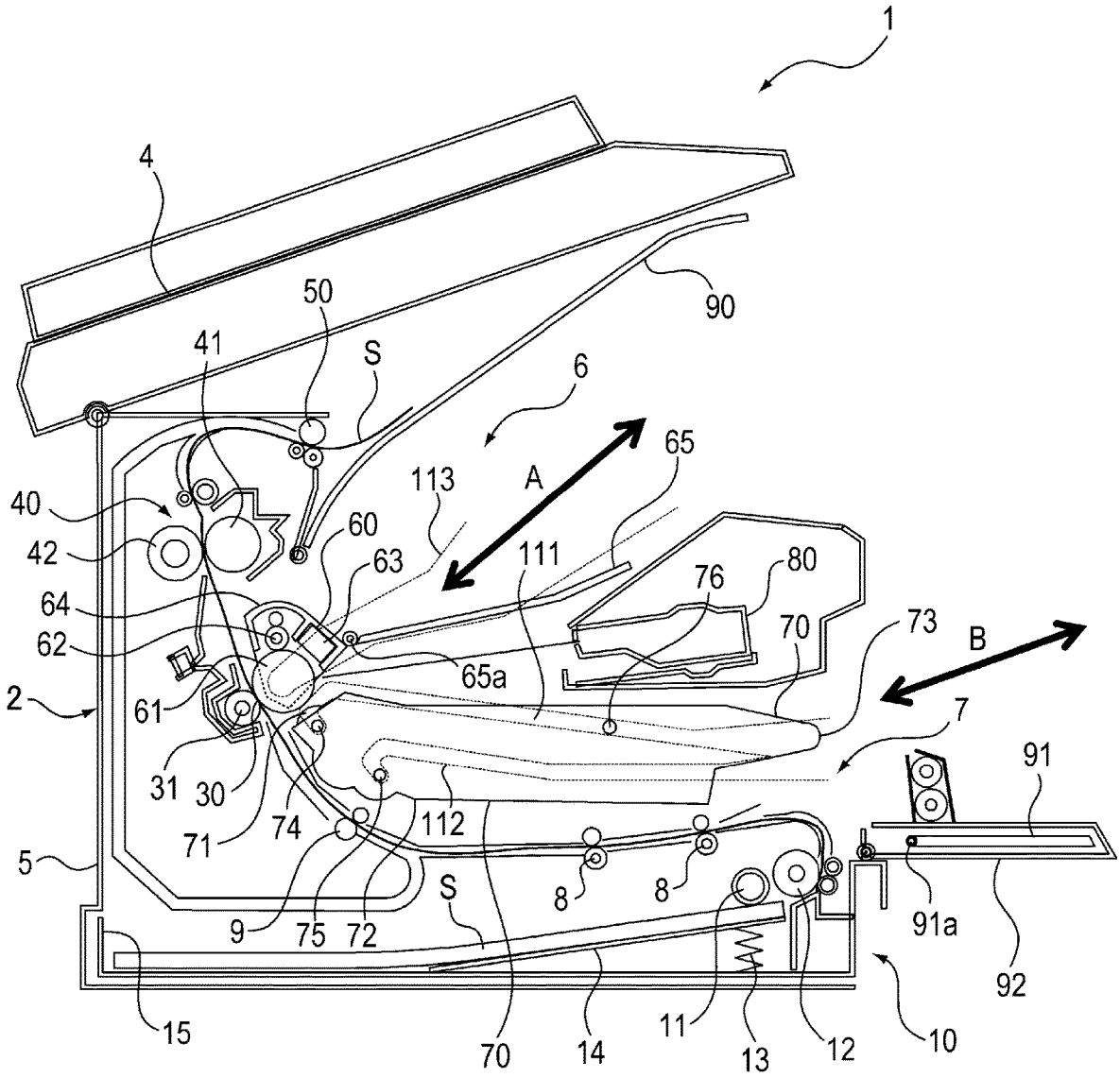
FIG. 2 is a sectional view showing a state in which a drum cartridge and a developing cartridge are inserted and extracted in a state in which an original reading portion, a discharge tray and a front door are opened.
Figure 3:
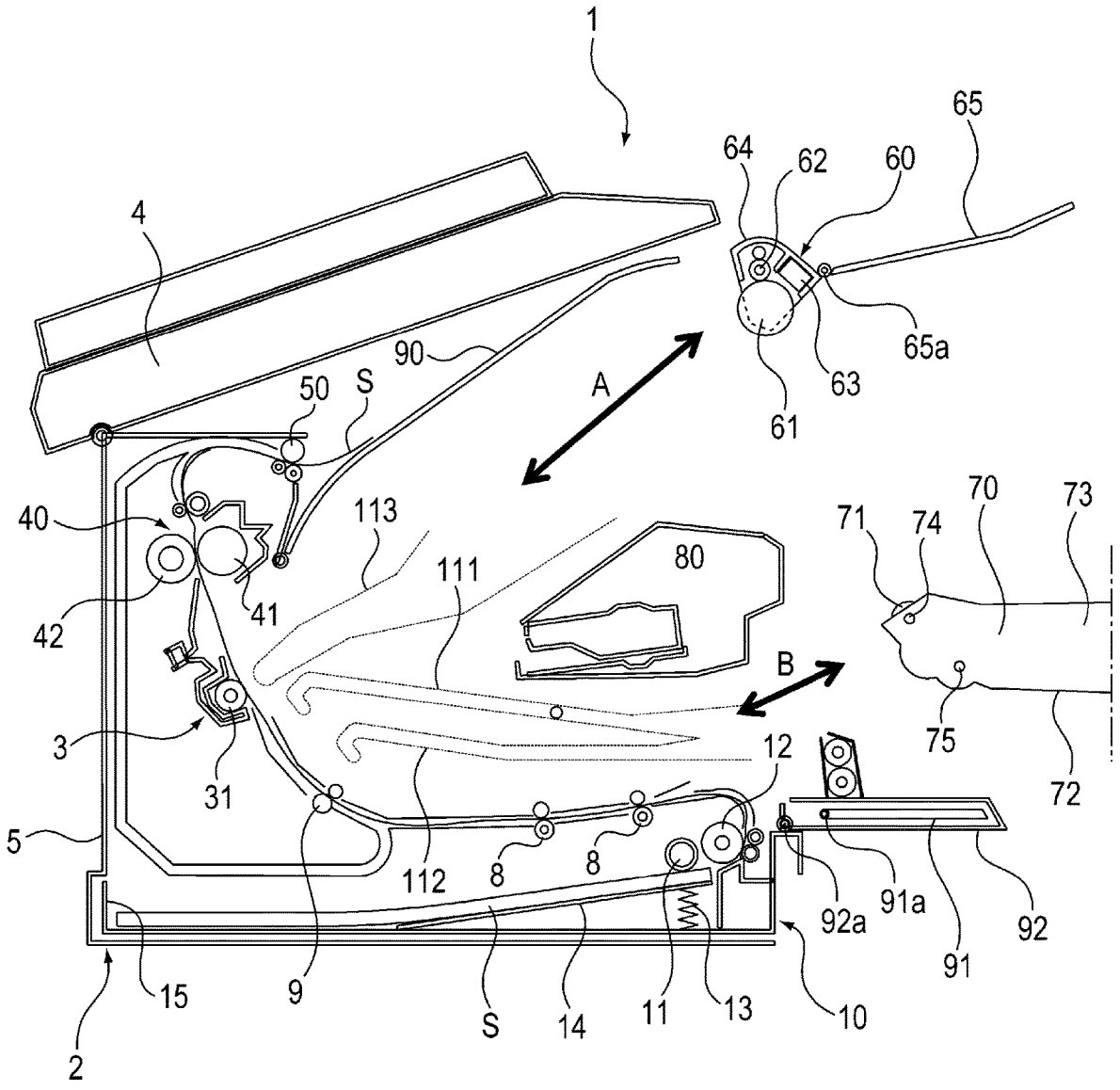
FIG. 3 is a sectional view showing a state in which the drum cartridge and the developing cartridge are taken out of associated mounting portions, respectively.

A structure of the image forming apparatus will be described using FIGS. 1 to 3. FIG. 1 is a sectional view showing a structure of an image forming apparatus 1. FIG. 2 is a sectional view showing a state in which a drum cartridge 60 and a developing cartridge 70 are inserted and extracted in a state in which an original reading portion 4, a discharge tray 90 and a front door 92 of the image forming apparatus 1 are opened. FIG. 3 is a sectional view showing a state in which the drum cartridge 60 and the developing cartridge 70 are taken out of associated mounting portions, respectively, of an apparatus main assembly 2 of the image forming apparatus 1. The image forming apparatus 1 shown in FIG. 1 is an example of a laser beam printer of an electrophotographic type. Incidentally, in the following description, "forward", "front side" and "front end portion" of the image forming apparatus 1 are those on a right-hand side in FIG. 1, and "rearward", "rear side" and "rear end portion" of the image forming apparatus 1 are those on a left-hand side in FIG. 1.

In FIG. 1, in the apparatus main assembly 2 of the image forming apparatus 1, the original reading portion 4 for reading image information of an original is provided. Further, in the apparatus main assembly 2, a feeding portion 10 for feeding a recording material S such as paper (sheet) to an image forming portion 3, the image forming portion for forming an image by an electrophotographic process, and a fixing unit 40 for fixing the image, formed by the image forming portion 3, on the recording material S are provided. Here, the apparatus main assembly 2 refers to a portion where the drum cartridge 60 and the developing cartridge 70 are removed from the image forming apparatus 1. The feeding portion 10 includes a feeding roller 11, a separation roller 12, a feeding tray 15 and an intermediate plate 14 and is provided on a bottom of the apparatus main assembly 2. On the intermediate plate 14 of the feeding tray 15, recording materials S are stacked and accommodated.

The front door 92 is provided with a manual feeding tray 91. The manual feeding tray 91 is configured to rotate about a supporting shaft 91*a* relative to the front door 92. The manual feeding tray 91 is rotated between a position where the feeding tray 91 is accommodated so as to overlap with the front door 92 as indicated by a solid line in FIG. 1 and a position where the recording material(s) S can be stacked as indicated by a broken line in FIG. 1.

The image forming portion 3 includes a photosensitive drum 61 as an image bearing member for forming a toner image and a transfer roller 31 as a transfer means for transferring the toner image, formed on the photosensitive drum 61, onto the recording material S. Further, the image forming portion 3 includes a cleaning roller 62 as a cleaning means for removing toner remaining on the surface of the photosensitive drum 61 after the transfer. Further, the image forming portion 3 includes a corona charger 63 as a charging means for electrically charging the surface of the photosensitive drum 61 uniformly and a developing roller 71 as a developer carrying member for supplying the toner to the photosensitive drum 61 and includes the like means.

Incidentally, the photosensitive drum 61, the cleaning roller 62 and the corona charger 63 are supported by a drum frame 64 provided as a part of the drum cartridge 60. The drum cartridge 60 is provided with a drum gripping portion 65 supported rotatably about a shaft 65*a* provided on the drum frame 64 in a forward side of the apparatus main assembly 2.

As shown in FIG. 2, the drum cartridge 60 including the photosensitive drum 61 as the image bearing member is mounted so as to be mountable in and dismountable from the apparatus main assembly 2 in an arrow A direction of FIG. 2 by opening the discharge tray 90 and then gripping the drum gripping portion 65 by a user. The discharge tray 90 as a first openable member is movable between a first open position where a first opening 6 through which the drum cartridge 60 passes when the drum cartridge 60 is mountable in and dismountable from the apparatus main assembly 2 is open as shown in FIG. 2 and a first closed position where the first opening 6 is closed as shown in FIG. 1. In other words, the discharge tray 90 is configured to be movable between the first open position and the first closed position.

The developing cartridge 70 includes the developing roller 71, a developing (roller) frame 72 and a developing (roller) gripping portion 73. As shown in FIG. 2, the developing cartridge 70 is mounted so as to be mountable in and dismountable from the apparatus main assembly 2 in an arrow B direction of FIG. 2 by opening the front door 92 and then gripping the developing gripping portion 73 by the user. The front door 92 is movable between a second open position where a second opening 7, through which the developing cartridge 70 passes when the developing cartridge 70 is mountable in and dismountable from the apparatus main assembly 2, is open as shown in FIG. 2. A fixing unit 40 includes a heating unit 41 and a pressing roller 42. The fixing unit 40 is constituted as a single unit and is mounted in the apparatus main assembly 2 so as to be capable of being exchanged (replaced). The front door 92 is configured to be movable between the second open position and the second closed position.

<Image Forming Apparatus>

Next, an image forming operation of the image forming apparatus 1 will be described. The photosensitive drum 61 as the image bearing member rotates in a clockwise direction of FIG. 1. The surface of the photosensitive drum 61 is cleaned by the cleaning roller 62 as a cleaning means and is electrically charged uniformly by the corona charger 63 as a charging means.

Then, on the basis of an image signal sent from an unshown host computer, the surface of the photosensitive drum 61 rotating in the clockwise direction in FIG. 1 is irradiated with laser light 80*a* emitted from a laser scanner 80 as an exposure means. By this, an electrostatic latent image is formed on the photosensitive drum 61. Then, toner carried on the surface of the developing roller 71 is supplied to the electrostatic latent image formed on the surface of the photosensitive drum 61, so that a toner image is formed on the surface of the photosensitive drum 61.

On the other hand, the feeding roller 11 starts rotation at predetermined timing, and in interrelation therewith, the intermediate plate 14 presses toward the feeding roller 11 side by a pressing force of a coil spring 13. By this, a leading end portion of the recording material S stacked on the intermediate plate 14 is press-contacted to the feeding roller 11 by a predetermined force. The feeding roller 11 is controlled so as to rotate in a counter clockwise direction of FIG. 1 only during the feeding. The feeding roller 11 feeds the recording material S, press-contacted to the surface thereof, by a frictional portion. Incidentally, when a plurality of recording materials S on the intermediary plate 14 are fed simultaneously, by the action of the separation roller 12, only the uppermost recording material S is separated and fed toward a downstream side.

Then, the uppermost recording material S separated by the separating roller 12 is fed by feeding rollers 8 and a leading end thereof is abutted against a nip of a registration roller pair 9 which is at rest, so that oblique movement of the recording material S is corrected. Thereafter, the registration roller pair 9 rotates at predetermined timing, so that the recording material S is fed to a transfer portion 30 which is a nip between the photosensitive drum 61 and the transfer roller 31. At the transfer portion 30, the toner image formed on the surface of the photosensitive drum 61 is electrically attracted to the recording material S by the transfer roller 31, so that the toner image is transferred onto the recording material S.

Thereafter, the recording material S on which the toner image is transferred is nipped and fed by the photosensitive drum 61 and the transfer roller 31 and then is fed to the fixing unit 40 including the heating unit 41 and the pressing roller 42. In the fixing unit 40, the recording material S on which the toner image is carried is heated and pressed during feeding between the heating unit 41 and the pressing roller 42, so that the toner image is fixed on the recording material S. Thereafter, the recording material S is discharged by the discharging roller 50 onto the discharge tray 90 provided at an upper portion of the apparatus main assembly 2.

<Developing Cartridge>

The developing cartridge 70 as a developing means includes the developing roller 71 and a developing frame 72 and is provided so as to be mountable in and dismountable from the apparatus main assembly 2 in an arrow B direction through the second opening 7. The developing frame 72 is provided with the developing gripping portion 73 for gripping the developing cartridge 70 by the user on the front door 92 side with respect to a mounting and dismounting direction shown as the arrow B direction of FIG. 2.

On both side surfaces of the developing frame 72 with respect to a longitudinal direction (from a front side toward a rear side of FIG. 1), as three projections projecting in an axial direction of the developing roller 71, a first developing projection 74, a second developing projection 75 and a third developing projection 76 are provided. The first developing projection 74 as a first projection is disposed substantially coaxially with a rotation shaft of the developing roller 71 as a developer carrying member. The third developing projection 76 as a second projection is disposed on a forward surface (right side of FIG. 4) than the first developing projection 74 as the first projection with respect to the mounting and dismounting direction.

The second developing projection 75 is disposed below the first developing projection 74. The third developing projection 76 is disposed on the front door 92 side than the first developing projection 74 and the second developing projection 75 with respect to the mounting and dismounting direction indicated as the arrow B direction. When the developing cartridge 70 is mounted in the apparatus main assembly 2, the first developing projection 74 is guided by a guiding portion 111*a* as a first guiding portion of a first developing guide 111 shown in FIG. 4 and thereafter is guided by guiding portions 111*b* and 111*c* as second guiding portions and by a restricting portion 111*d*. On the other hand, the third developing projection 76 as the second projection is guided by the guiding portion 111*a* as the first guiding portion of the first developing guide 111.

<Main Assembly Casing>

Figure 4:
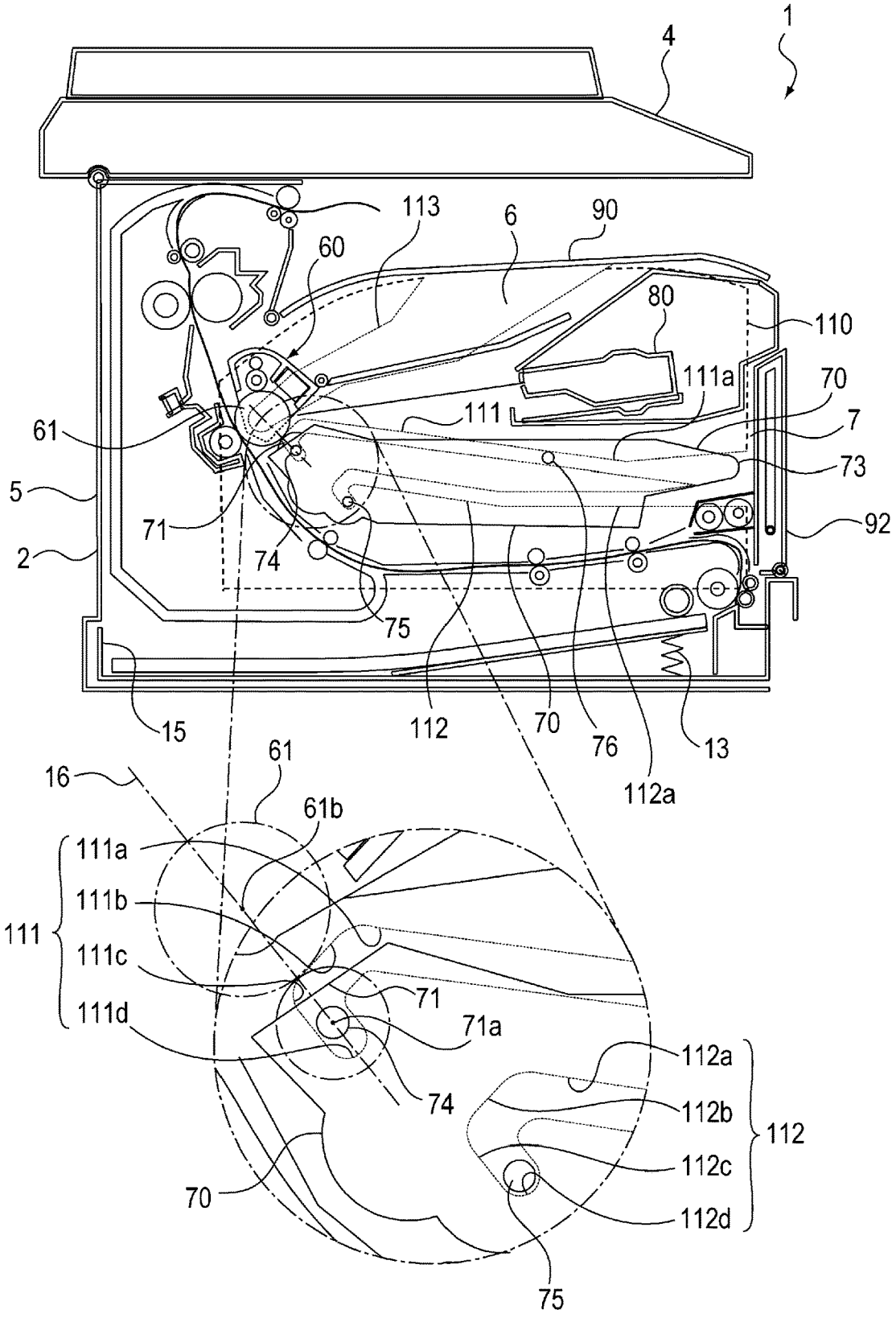
FIG. 4 is a sectional view showing a structure of the mounting portion for the developing cartridge.
Figure 5:
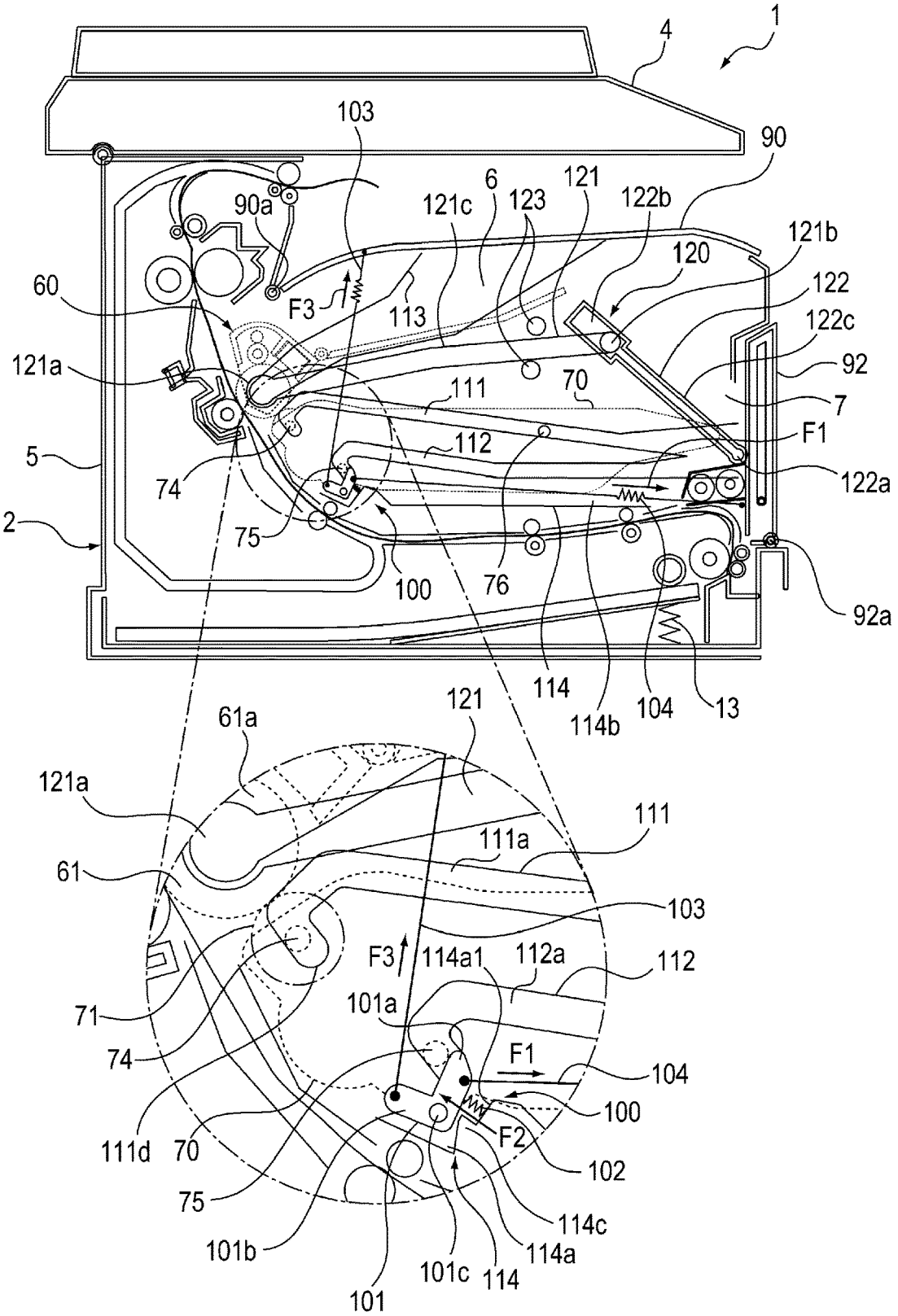
FIG. 5 is a sectional view showing a structure of the mounting portion for the developing cartridge when the front door is in a closed state.

A main assembly casing 5 will be described using FIGS. 4 and 5. FIG. 4 is a sectional view showing a structure of a mounting portion for the developing cartridge 70. FIG. 5 is a sectional view showing a structure of the mounting portion for the developing cartridge 70 when the front door 92 is in the closed state. The apparatus main assembly 2 includes the main assembly casing 5. The main assembly casing 5 includes a pair of side walls 110, a developing pressing mechanism 100 and a link unit 120.

The pair of side walls 110 shown in FIG. 4 is disposed inside the main assembly casing on left and right sides. Incidentally, the pair of side walls 110 is bilateral symmetry and therefore only the right(-hand) wall 110 will be described. The side wall 110 includes, as shown in FIGS. 4 and 5, the first developing guide 111, a second developing guide 112 provided below the first developing guide 111, a drum guide 113, a pressing mechanism accommodating portion 114 and a pair of guiding projections 123 shown in FIG. 5.

<Developing Guide>

The first developing guide 111 and the second developing guide 112 which are provided on the apparatus main assembly 2 side guide the developing cartridge 70. The first developing guide 111 and the second developing guide 112 are provided with the guiding portions 111*a* and 112*a*, respectively, as first guiding portions extending in the mounting and dismounting direction (left-right direction of FIG. 5) in which the developing cartridge is mounted and dismounted through the second opening 7.

Further, the first developing guide 111 and the second developing guide 112 include the guiding portions 111*b*, 111*c*, 112*b* and 112*c* and the restricting portions 111*d* and 112*d*. The guiding portions 111*b* and 112*b* are connected to the guiding portions 111*a* and 112*a*, respectively. The guiding portions 111*b*, 111*c*, 112*b* and 112*c* as the second guiding portions and the restricting portions 111*d* and 112*d* guide movement of the developing cartridge 70 between an image forming position of the developing cartridge 70 shown in FIG. 5 and a non-image forming position of the developing cartridge 70 shown in FIG. 7.

The first developing guide 111 and the second developing guide 112 are provided with the guiding portions 111*c* and 112*c*, respectively, as the second guiding portions. Here, a rotation center 71*a* of the developing roller 71 as the developer carrying member of the developing cartridge 70 mounted at the image forming position of the apparatus main assembly 2 shown in FIG. 4 will be considered. Further, a rotation center 61*b* of the photosensitive drum 61 as the image bearing member of the drum cartridge 60 mounted at the image forming position of the apparatus main assembly 2 shown in FIG. 4 will be considered. Further, a rectilinear line 16 connecting the rotation center 71*a* and the rotation center 61*b* will be considered. The guiding portions 111*c* and 112*c* extend substantially in parallel to the rectilinear line 16.

As shown in FIG. 4, when the drum cartridge 60 and the developing cartridge 70 which are mounted in the apparatus main assembly 2 are in the image forming position, the developing roller 71 as the developer carrying member and the photosensitive drum 61 as the image bearing member are in a contact state. The first developing guide 111 is disposed at a substantially central portion of the side wall 110 with respect to an up-down direction, and has a V-shape such that the first developing guide 111 inclines and extends upward from the front side (right side of FIG. 4) toward the rear side (left side of FIG. 4) of the apparatus main assembly 2 and thereafter bends forward and downward as shown in FIG. 4.

Specifically, the first developing guide 111 includes the guiding portions 111*a* to 111*c* and the restricting portion 111*d* which are shown in FIG. 4. The guiding portion 111*a* is disposed at a substantially central portion of the side wall 110 with respect to an up-down direction, and inclines and extends upward from the front side toward the rear side of the apparatus main assembly 2. The guiding portion 111*b* extends from an upper end portion of the guiding portion 111*a* on the rear side in the apparatus main assembly 2 rearward and downward.

The guiding portion 111*c* extends from a lower end portion of the guiding portion 111*b* on the rear side of the apparatus main assembly 2 and is connected to an upper end portion of the restricting portion 111*d* on the rear side of the apparatus main assembly 2. The restricting portion 111*d* is provided at a lower end portion of the guiding portion 111*c* on the front side in the apparatus main assembly 2. The restricting portion 111*d* supports the first developing projection 74 of the developing cartridge 70 in a state in which the developing cartridge 70 is mounted in the main assembly casing 5. Further, the third developing projection 76 of the developing cartridge 70 is guided by the guiding portion 111*a*.

The second developing guide 112 is disposed below the first developing guide 111 at a substantially central portion of the side wall 110 with respect to an up-down direction, and has a V-shape such that the first developing guide 111 inclines and extends upward from the front side toward the rear side of the apparatus main assembly 2 and thereafter bends forward and downward as shown in FIG. 4. Specifically, the second developing guide 112 includes the guiding portions 112*a* to 112*c* and the restricting portion 112*d* which are shown in FIG. 4.

The guiding portion 112*a* is disposed at a substantially central portion of the side wall 110 with respect to an up-down direction, and inclines and extends upward from the front side toward the rear side of the apparatus main assembly 2. The guiding portion 112*b* extends from an upper end portion of the guiding portion 112*a* on the rear side in the apparatus main assembly 2 rearward and downward. The guiding portion 112*c* extends from a lower end portion of the guiding portion 112*b* on the rear side of the apparatus main assembly 2 and is connected to an upper end portion of the restricting portion 111*d* on the rear side of the apparatus main assembly 2.

The restricting portion 112*d* is provided at a lower end portion of the guiding portion 112*c* on the front side in the apparatus main assembly 2. The restricting portion 112*d* is disposed at a lower front portion of the restricting portion 111*d* of the first developing guide 111 in the apparatus main assembly 2. The guiding portion 112*c* of the second developing guide 112 extends in parallel to the guiding portion 111*c* of the first developing guide 111.

When the developing cartridge 70 is mounted in and dismounted from the apparatus main assembly 2, the first developing projection 74 and the third developing projection 76 which are provided on the developing cartridge 70 are guided by the first developing guide 111 provided on the apparatus main assembly 2 side. On the other hand, the second developing projection 75 provided on the developing cartridge 70 is guided by the second developing guide 112 provided on the apparatus main assembly 2 side.

At this time, a space occupied by the photosensitive drum 61 as the image bearing member when the drum cartridge 60 mounted in the apparatus main assembly 2 is in the image forming position shown in FIG. 4 will be considered. The developing roller 71 as the developer carrying member of the developing cartridge 70 is capable of passing through this space after the drum cartridge 60 is retracted to the non-image forming position.

That is, when the developing cartridge 70 is mounted in and dismounted from the apparatus main assembly 2, the front door 92 is opened. At this time, the drum cartridge 60 is pulled toward the right side in FIG. 7 by the link unit 120 connected to the front door 92 and thus is retracted to the non-image forming position. For this reason, the space occupied by the photosensitive drum 61 as the image bearing member when the drum cartridge 60 mounted in the apparatus main assembly 2 is in the image forming position shown in FIG. 4 will be considered. The developing roller 71 as the developer carrying member of the developing cartridge 70 is capable of passing through this space after the photosensitive drum 61 is retracted to the non-image forming position.

The first developing projection 74 and the second developing projection 75 which are provided on the developing cartridge 70 will be considered. These projections move along the guiding portion 111*a* (first guiding portion), the guiding portions 111*b* and 111*c* (second guiding portions) and the restricting portion 111*d* and along the guiding portion 112*a* (first guiding portion), the guiding portions 112*b* and 112*c* (second guiding portions) and the restricting portion 112*d*, respectively.

In this embodiment, an example of a constitution in which the third developing projection 76 of the developing cartridge 70 is guided by the guiding portion 111*a* of the first developing guide 111 is described. As another example, a constitution in which the third developing projection 76 of the developing cartridge 70 is guided by the guiding portion 112*a* of the second developing guide 112.

<Shape of Drum Guide>

The drum guide 113 is disposed above the first developing guide 111 as shown in FIG. 4 and has a recessed shape from an inside toward an outside of the side wall 110 of the apparatus main assembly 2. The drum guide 113 extends from an upper rear side toward an upper front side of the restricting portion 111*d* of the first developing guide 111 in the apparatus main assembly 2 as shown in FIG. 4. The drum guide 113 is formed so as to increase in width toward an upper front side of the apparatus main assembly 2. The drum guide 113 guides the drum cartridge 60.

<Pressing Mechanism Accommodating Portion>

The photosensitive drum mechanism accommodating portion 114 is disposed below the second developing guide 112 as shown in FIG. 5. The pressing mechanism accommodating portion 114 is disposed inside the side wall 110. The pressing mechanism accommodating portion 114 includes a pressing member accommodating portion 114*a* consisting of a space extending in a front-rear (forward-rearward) direction of the apparatus main assembly 2 and includes a (pressing-)releasing member accommodating portion 114*b*.

The pressing member accommodating portion 114*a* is disposed at a rear(-side) end portion of the pressing mechanism accommodating portion 114 in the apparatus main assembly 2 on a lower front side of the apparatus main assembly 2 than the restricting portion 112*d* of the second developing guide 112 is. The releasing member accommodating portion 114*b* extends from a lower end portion of the second opening 7 shown in FIG. 2 toward the rear side of the apparatus main assembly 2 and extends continuously to an upper end portion of the pressing member accommodating portion 114*a*. The first opening 6 is an opening through which the drum cartridge 60 passes when the drum cartridge 60 is mounted and dismounted.

<Developing Pressing Mechanism>

The developing pressing mechanism 100 includes, as shown in FIG. 5, a developing pressing member 101, a pressing spring 102, a first pressing releasing member 103 and a second pressing releasing member 104. The developing pressing member 101 as a pressing member is supported rotatably about a developing pressing shaft 101*c* provided as a rotation center in the apparatus main assembly 2. The developing pressing member 101 includes a pressing portion 101*a* for pressing the second developing projection 75 of the developing cartridge 70 and a non-pressing portion 101*b* provided on a side opposite from the pressing portion 101*a* with respect to the developing pressing shaft 101*c* as the rotation center of the developing pressing member 101.

The pressing spring 102 as an urging member presses the pressing portion 101*a* toward the second developing projection 75 of the developing cartridge 70. The pressing spring 102 presses the developing cartridge 70 so that the developing roller 71 provided as the developer carrying member in the developing cartridge 70 contacts the photosensitive drum 61 provided as the image bearing member in the drum cartridge 60. By this, the developing cartridge 70 is moved to the image forming position shown in FIG. 5.

Figure 6:
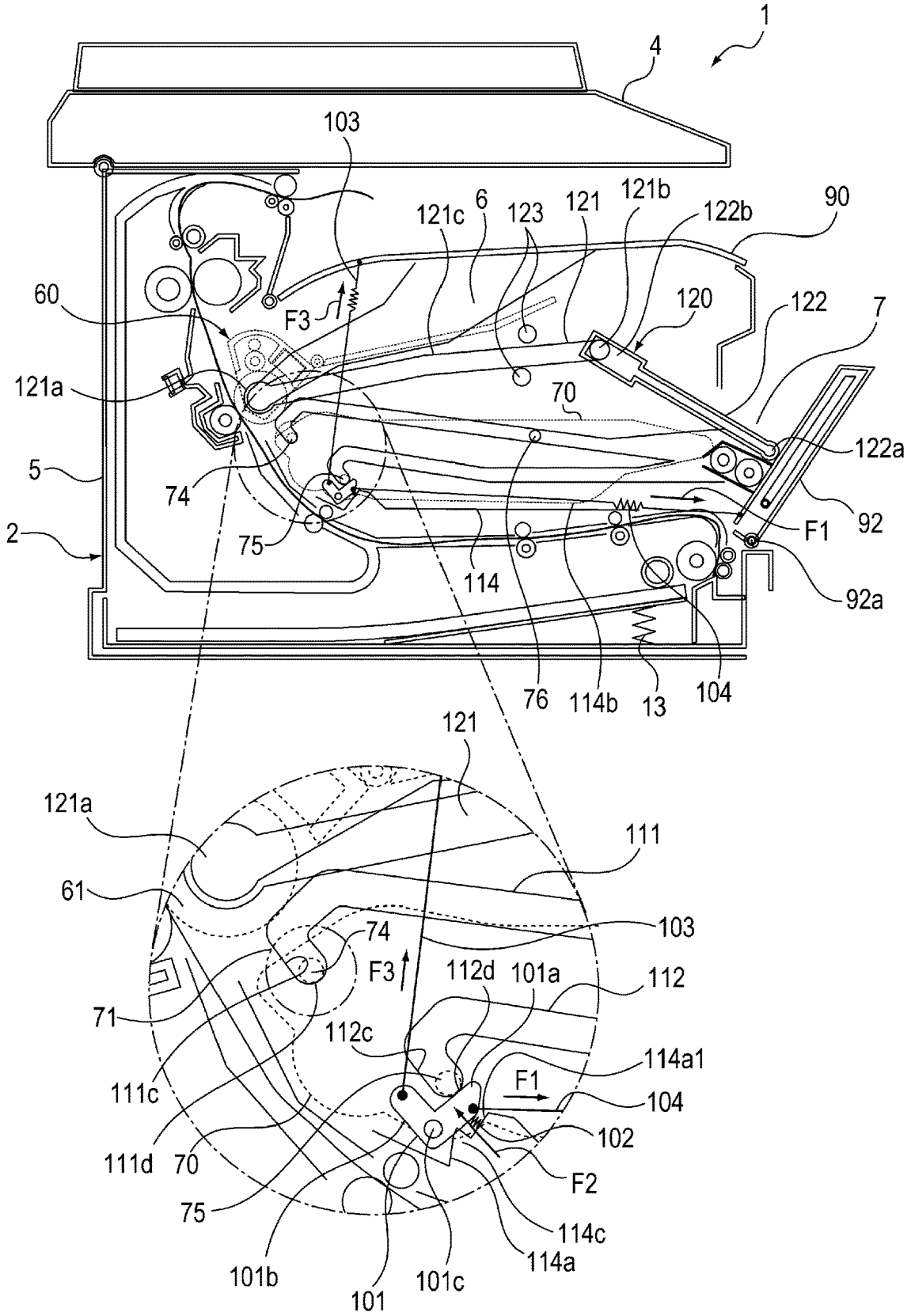
FIG. 6 is a sectional view showing a structure of the mounting portion for the developing cartridge when the front door is in a process of being opened or closed.

The developing pressing member 101 is disposed in the pressing member accommodating portion 114*a* of the pressing mechanism accommodating portion 114. The developing pressing member 101 is formed in an L-shape and is constituted by the pressing portion 101*a* and the non-pressing portion 101*b*. Further, the developing pressing member 101 is constituted so as to be rotatable about the developing pressing shaft 101*c*. The developing pressing member 101 is movable between a pressing position where the developing pressing member 101 presses the developing cartridge 70 shown in FIG. 5 so that the developing roller 71 contacts the photosensitive drum 61 and a pressing releasing position where the developing cartridge 70 is released from the developing pressing member 101 as shown in FIG. 6.

The pressing spring 102 is compression spring and is provided between the developing pressing member 101 and a front wall 114*a*1 of the pressing member accommodating portion 114*a*. By a pressing force F2 of the pressing spring 102, the developing pressing member 101 is moved about the developing pressing shaft 101*c* in the counter clockwise direction of FIG. 5. The pressing portion 101*a* is, as shown in FIG. 5, by being pressed by the pressing spring 102, contacted to a front(-side) lower end portion of the second developing projection 75 provided in the developing cartridge 70 in the apparatus main assembly 2.

The first pressing releasing member 103 is connected between the discharge tray 90 as a first openable member and the non-pressing portion 101*b* of the developing pressing member 101. The first pressing releasing member 103 interrelates with an opening and closing operation by rotation of the discharge tray 90 about a discharge tray shaft 90*a* as a rotation center. By this the first pressing releasing member 103 releases a pressing state of the pressing spring 102 as the urging member for pressing (urging) the pressing portion 101*a* of the developing pressing member 101 about the developing pressing shaft 101*a* as a rotation center in the counter clockwise direction of FIG. 5. That is, the first pressing releasing member 103 releases the developing cartridge 70 from the pressing spring 102 as the urging member in interrelation with movement of the discharge tray 90 as the first openable member from a first closed position shown in FIG. 1 to a first open position shown in FIG. 2.

Figure 12:
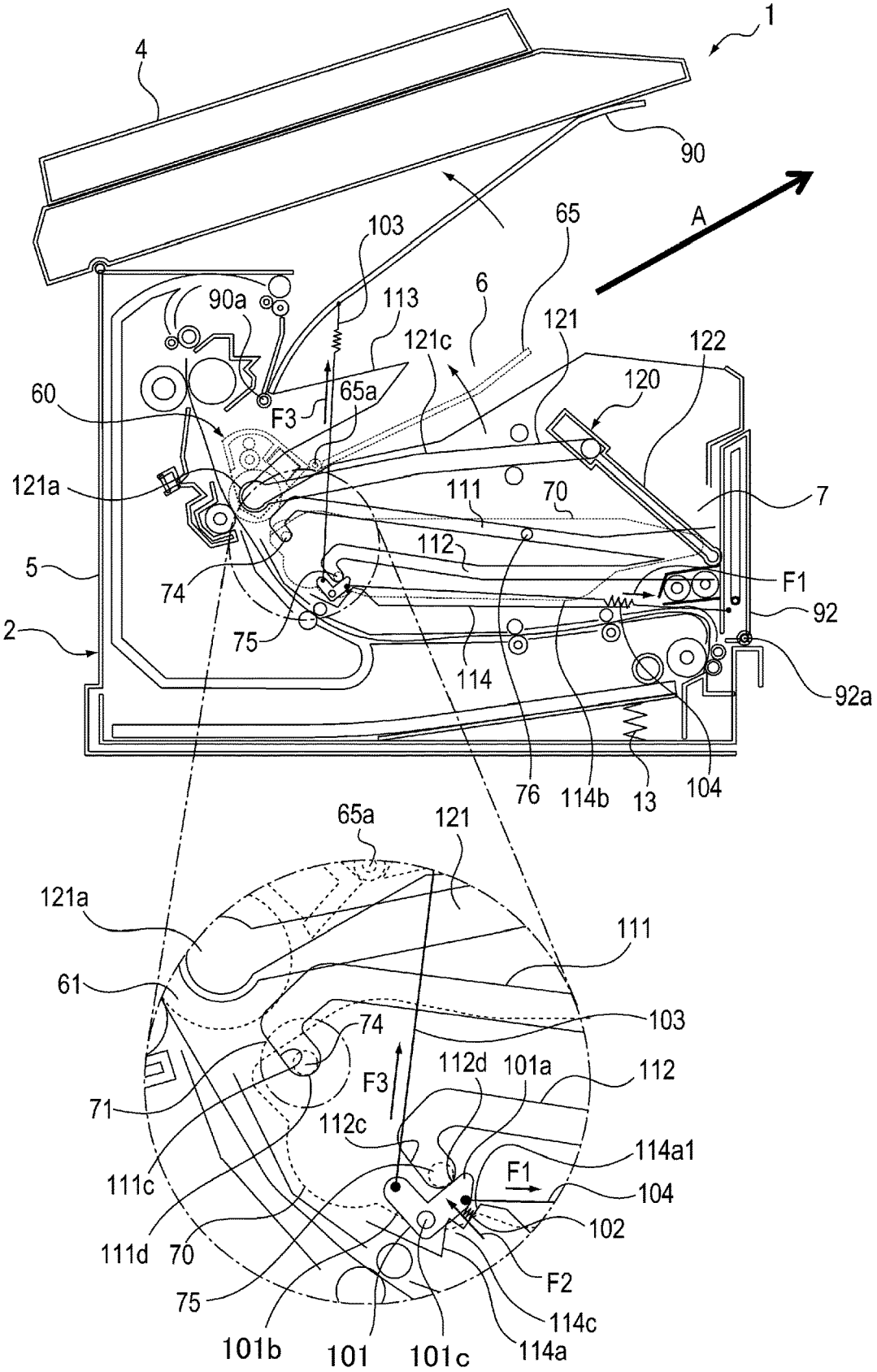
FIG. 12 is a sectional view showing a structure of the mounting portion for the developing cartridge when the original reading portion is in the closed state and the discharge tray is in an open state.

The discharge tray 90 as the first openable member is opened by being rotated about the discharge tray shaft 90*a* in the counter clockwise direction of FIG. 12. At this time, the first pressing releasing member 103 pulls the non-pressing portion 101*b* of the developing pressing member 101 in an upward direction. By this, the developing pressing member 101 rotates about the developing pressing shaft 101*c* in the clockwise direction of FIG. 12 against a pressing force F2 of the pressing spring 102 as the urging member. By this, the pressing state of the pressing portion 101*a* of the developing pressing member 101 against the second developing projection 75 provided on the developing cartridge 70 by the pressing spring 102 is released by the first pressing releasing member 103.

Figure 7:
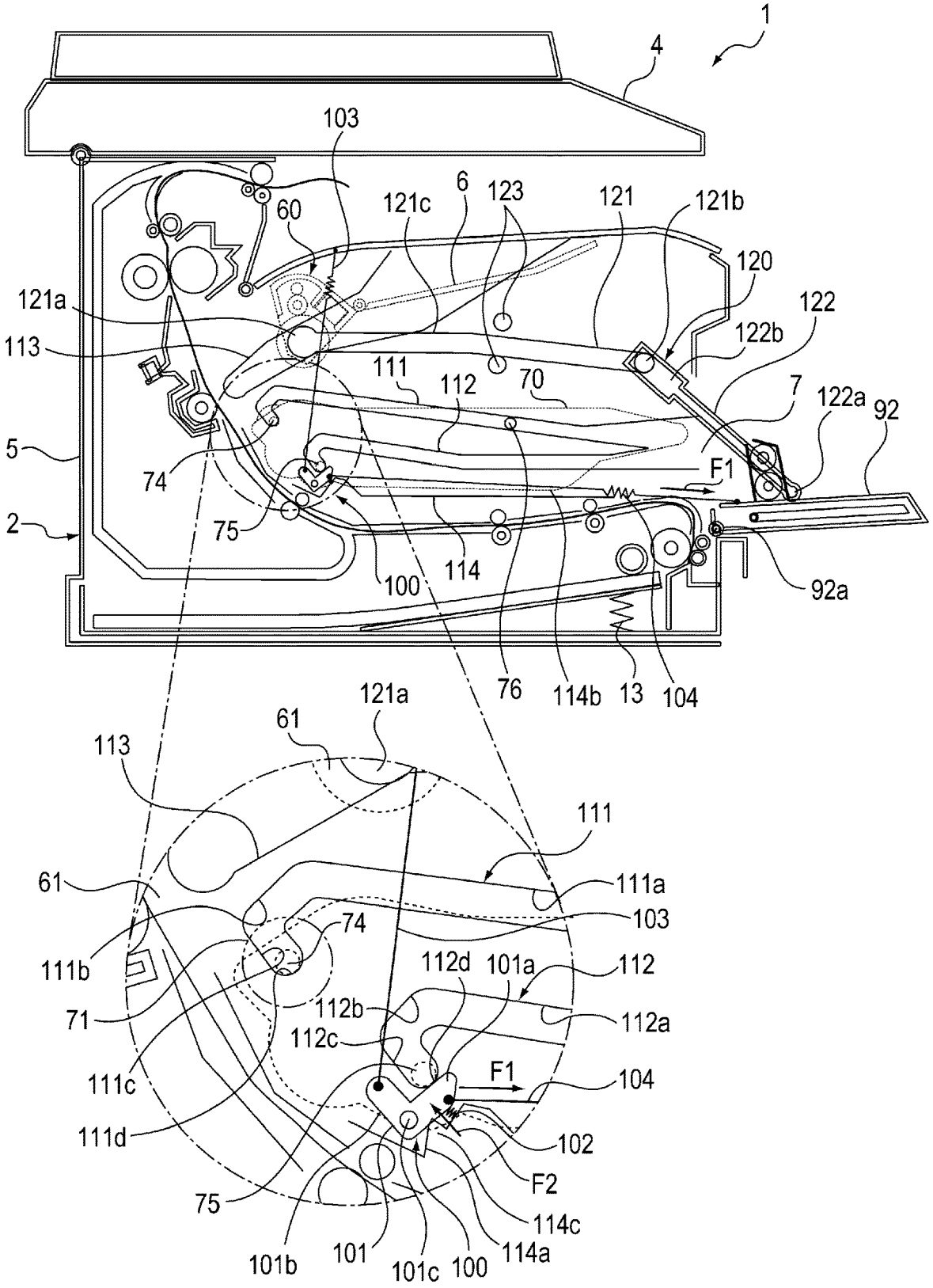
FIG. 7 is a sectional view showing a structure of the mounting portion for the developing cartridge when the front door is in an open state.

At this time, by a self-weight of the developing cartridge 70, the first developing projection 74 provided on the developing cartridge 70 is guided by the guiding portion 111*c* of the first pressing guide 111 shown in FIG. 4 and reaches the restricting portion 111*d*. Further, the second developing projection 75 provided on the developing cartridge 70 is guided by the guiding portion 112*c* of the second developing guide 112 and reaches the restricting portion 112*d*. By this, the developing cartridge 70 moves from an image forming position shown in FIG. 11 to a non-image forming position shown in FIG. 12. As shown in FIGS. 7 and 12, the non-image forming position of the developing cartridge 70 is disposed substantially below the image forming position of the developing cartridge 70 shown in FIGS. 5 and 11.

The second pressing releasing member 104 is a tension spring and is disposed in a releasing member accommodating portion 114*b* of the pressing member accommodating portion 114. The second pressing releasing member 104 is connected between the front door 92 as a second openable member and the pressing portion 101*a* of the developing pressing member 101. The second pressing releasing member 104 interrelates with the opening and closing operation of the front door 92 by rotation of the front door 92 about the front door shaft 92*a* as a rotation center.

For this reason, the second pressing releasing member 104 releases a pressing state of the pressing spring 102 as the urging member for pressing (urging) the pressing portion 101*a* of the developing pressing member 101 about the developing pressing shaft 101*a* as a rotation center in the counter clockwise direction of FIG. 5. That is, the second pressing releasing member 104 releases the developing cartridge 70 from the pressing portion 101*a* of the developing pressing member 101 as the pressing member in interrelation with movement of the front door 92 as the second openable member from a second closed position shown in FIG. 1 to a second open position shown in FIG. 2.

The front door 92 as the second openable member is opened by being rotated about the front door shaft 92*a* in the clockwise direction of FIGS. 6 and 7. At this time, the second pressing releasing member 104 pulls the pressing portion 101*a* of the developing pressing member 101 in a rightward direction. By this, the developing pressing member 101 rotates about the developing pressing shaft 101*c* in the clockwise direction of FIGS. 6 and 7 against a pressing force F2 of the pressing spring 102 as the urging member. By this, the pressing state of the pressing portion 101*a* of the developing pressing member 101 against the second developing projection 75 provided on the developing cartridge 70 by the pressing spring 102 is released by the second pressing releasing member 104.

That is, in interrelation with the movement of the front door 92 as the second openable member from the second closed position shown in FIG. 5 to the second open position shown in FIG. 7, the second pressing releasing member 104 pulls the pressing portion 101*a* of the developing pressing member 101. By this, the developing pressing member 101 is rotated about the developing pressing shaft 101*c* in a non-pressing direction (counter clockwise direction of FIG. 7) against the pressing force F2 of the pressing spring 102 as the urging member. As a result, it is possible to release the second developing projection 75 of the developing cartridge 70 from the pressing portion 101*a* of the developing pressing member 101.

At this time, by the self-weight of the developing cartridge 70, the first developing projection 74 provided on the developing cartridge 70 is guided by the guiding portion 111*c* of the first pressing guide 111 shown in FIG. 4 and reaches the restricting portion 111*d*. Further, the second developing projection 75 provided on the developing cartridge 70 is guided by the guiding portion 112*c* of the second developing guide 112 and reaches the restricting portion 112*d*. By this, the developing cartridge 70 moves from an image forming position shown in FIG. 5 to a non-image forming position shown in FIG. 7.

Here, a tensile force of the second pressing releasing member 104 is defined as F1 and the pressing force of the pressing spring 102 is defined as F2. As shown in FIG. 5, in a closed state of the front door 92, a relationship between the tensile force F1 and the pressing force F2 is F1<F2. Further, as shown in FIG. 7, in an open state of the front door 92, a relationship between the tensile force F1 and the pressing force F2 is F1>F2.

When the front door 92 as the second openable member is in the second closed position shown in FIG. 5, the tensile force F1 of the tension spring as the second pressing releasing member 104 is smaller than the pressing force F2 of the pressing spring 102 as the urging member. By this, the pressing portion 101*a* of the developing pressing member 101 presses the second developing projection 75 of the developing cartridge 70 by the pressing force F2 of the pressing spring 102, so that the developing roller 71 can be contacted to the photosensitive drum 61.

When the front door 92 as the second openable member is in the second open position shown in FIG. 7, the tensile force F1 of the tension spring as the second pressing releasing member 104 is larger than the pressing force F2 of the pressing spring 102 as the urging member. By this, the pressing portion 101*a* of the developing pressing member 101 releases pressing of the second developing projection 75 of the developing cartridge 70 against the pressing force F2 of the pressing spring 102. By this the developing roller 71 can be separated from the photosensitive drum 61.

The first pressing releasing member 103 is a tension spring. Here, a tensile force of the first pressing releasing member 103 is defined as F3. As shown in FIG. 5, in a closed state of the discharge tray 90, a relationship between the tensile force F3 and the pressing force F2 is F3<F2. Further, as shown in FIG. 12, in an open state of the discharge tray 90, a relationship between the tensile force F3 and the pressing force F2 is F3>F2.

The first pressing releasing member 103 and the second pressing releasing member 104 in this embodiment are an example thereof constituted by the tension springs. As another example, a member which is a combination of an arm member and the tension spring and a member which is a combination of an arm provided with an elongated hole and a developing pressing member 101 provided with a shaft engageable with the elongated hole may also be used. Further, in this embodiment, the developing pressing member 101 is formed in the L-shape, but when a constitution in which the developing pressing member 101 is rotated in the clockwise direction by tension of two pressing releasing members is employed, a developing pressing member having another shape such as a V-shape may also be used.

Further, the pressing spring 102 is constituted by the compression spring, but other-shaped springs such as a tension spring and a (helical) torsion coil spring may also be used. Further, the first pressing releasing member 103 has a constitution in which the discharge tray 90 and the non-pressing portion 101*b* of the developing pressing member 101 are connected, but a constitution in which the first pressing releasing member 103 connects the discharge tray 90 and the pressing portion 101*a* may also be employed.

As a specific constitution, there is a need that a force for pulling the first pressing releasing member 103 in a substantially upward direction when the discharge tray 90 is opened is converted into a force for pulling the pressing portion 101*a* in a substantially formed (frontward) direction of the apparatus main assembly 2. As such a constitution in which the direction of the tensile force is converted, a constitution such that the first pressing releasing member 103 is caused to extend substantially forward from the pressing portion 101*a* in the apparatus main assembly 2 and passes through a guiding portion provided on the side wall 110, and then extends in a substantially upward direction and is connected to the discharge tray 90 may also be employed.

As another constitution, a constitution in which the direction of the tensile force of the first pressing releasing member 103 is converted using two link members may also be used. In this case, the shape of the pressing releasing member may be not only the L-shape or the V-shape, but also the pressing releasing member may also be constituted only by the pressing portion 101*a* provided with no non-pressing portion 101*b*.

In this embodiment, an example of a constitution in which the pressing portion 101*a* is released from the pressing spring 102 in interrelation with the opening and closing operation of the discharge tray 90 by connecting the first pressing releasing member 103 to the discharge tray 90 is described. As another example, the first pressing releasing member 103 is connected to the original reading portion 4 and the pressing portion 101*a* is released from the pressing spring 102 in interrelation with the opening and closing operation of the original reading portion 4.

<Drum Moving Member>

In the apparatus main assembly 2, the link unit 120 as a drum moving member is provided. The link unit 120 interrelates with the opening and closing operation of the front door 92 as the second openable member rotating about the front door shaft 92*a*. The link unit 120 moves the drum cartridge 60 between the image forming position shown in FIG. 5 and the non-image forming position shown in FIG. 7 in interrelation with the opening and closing operation of the front door 92.

The force 92 is rotated about the front door shaft 92*a* in the clockwise direction of FIG. 6, so that the front door 92 is opened from the closed position shown in FIG. 5 to an intermediate position shown in FIG. 6. At that time, the pressing portion 101*a* is pulled in the rightward direction of FIG. 6 against the pressing force F2 of the pressing spring 102 by the second pressing releasing member 104 connected between the front door 92 and the pressing portion 101*a* of the developing pressing member 101. By this, the developing pressing member 101 is rotated about the developing pressing shaft 101*c* in the clockwise direction of FIG. 6. As a result, the pressing state of the pressing portion 101*a* of the developing pressing member 101 by the developing spring 102 against the second developing projection 75 provided on the developing cartridge 70 is released by the second pressing releasing member 104.

At this time, by the self-weight of the developing cartridge 70, the first developing projection 74 provided on the developing cartridge 70 is guided by the guiding portion 111*c* of the first developing guide 111 shown in FIG. 6.

Further, the second developing projection 75 provided on the developing cartridge 70 is guided by the guiding portion 112*c* of the second developing guide 112 shown in FIG. 6. By this, the developing cartridge 70 moves forward and downward with respect to the apparatus main assembly 2. As a result, the developing cartridge 70 moves from the image forming position shown in FIG. 5 to the non-image forming position shown in FIG. 6.

Further, the front door 92 is opened from the intermediate position shown in FIG. 6 to the open position shown in FIG. 7 by being rotated about the front door shaft 92*a* in the clockwise direction of FIG. 7. At that time, the drum cartridge 60 is pulled in the rightward direction by the link unit 120 as the drum moving member connected between the front door 92 and the drum cartridge 60. As a result, the developing cartridge 60 is moved from the image forming position shown in FIG. 5 to the non-image forming position shown in FIG. 7.

The link unit 120 as the drum moving member includes a first link arm 121 and a second link arm 122 as shown in FIG. 5. The first link arm 121 is constituted by including a drum holding portion 121*a*, a first arm projection 121*b* and a first arm main body portion 121*c*.

The drum holding portion 121*a* is disposed on a rear end portion side of the first link arm 121 in the apparatus main assembly 2 and holds a drum end portion provided at each of longitudinal end portions of the photosensitive drum 61. The first arm main body portion 121*c* extends from the drum holding portion 121*a* toward the front side of the apparatus main assembly 2. The first arm main body portion 121*c* is guided by a pair of guiding projections 123, so that the first link arm 121 is movable in the front-rear direction of the apparatus main assembly 2. The first arm projection 121*b* is provided at a front end portion of the first link arm 121 in the apparatus main assembly 2.

The second link arm 122 is constituted by a second arm supporting point 122*a*, a second arm elongated hole 122*b* and a second arm main body portion 122*c*. The second link arm 122 is disposed on the front side of the apparatus main assembly 2 relative to the first link arm 121 and is connected with the first link arm 121 by engagement of the second arm elongated hole 122*b* and the first arm projection 121*b*.

The second arm main body portion 122*c* has a shape such that it extends from the second arm elongated hole 122*b* forward and downward in the apparatus main assembly 2. At a lower end portion of the second arm main body portion 122*c* on the front side of the apparatus main assembly 2, the second arm supporting point 122*a* is provided. The second arm supporting point 122*a* is connected to the front door 92. By this, the second link arm 122 is supported by the front door 92 rotatably about the second arm supporting point 122*a*. Further, as shown in FIG. 5, in a state of the closed position of the front door 92, the second arm elongated hole 122*b* receives the first arm projection 121*b* at a front side lower end (edge) thereof in the apparatus main assembly 2.

<Mounting and Dismounting Operation of Developing Cartridge>

Figure 8:
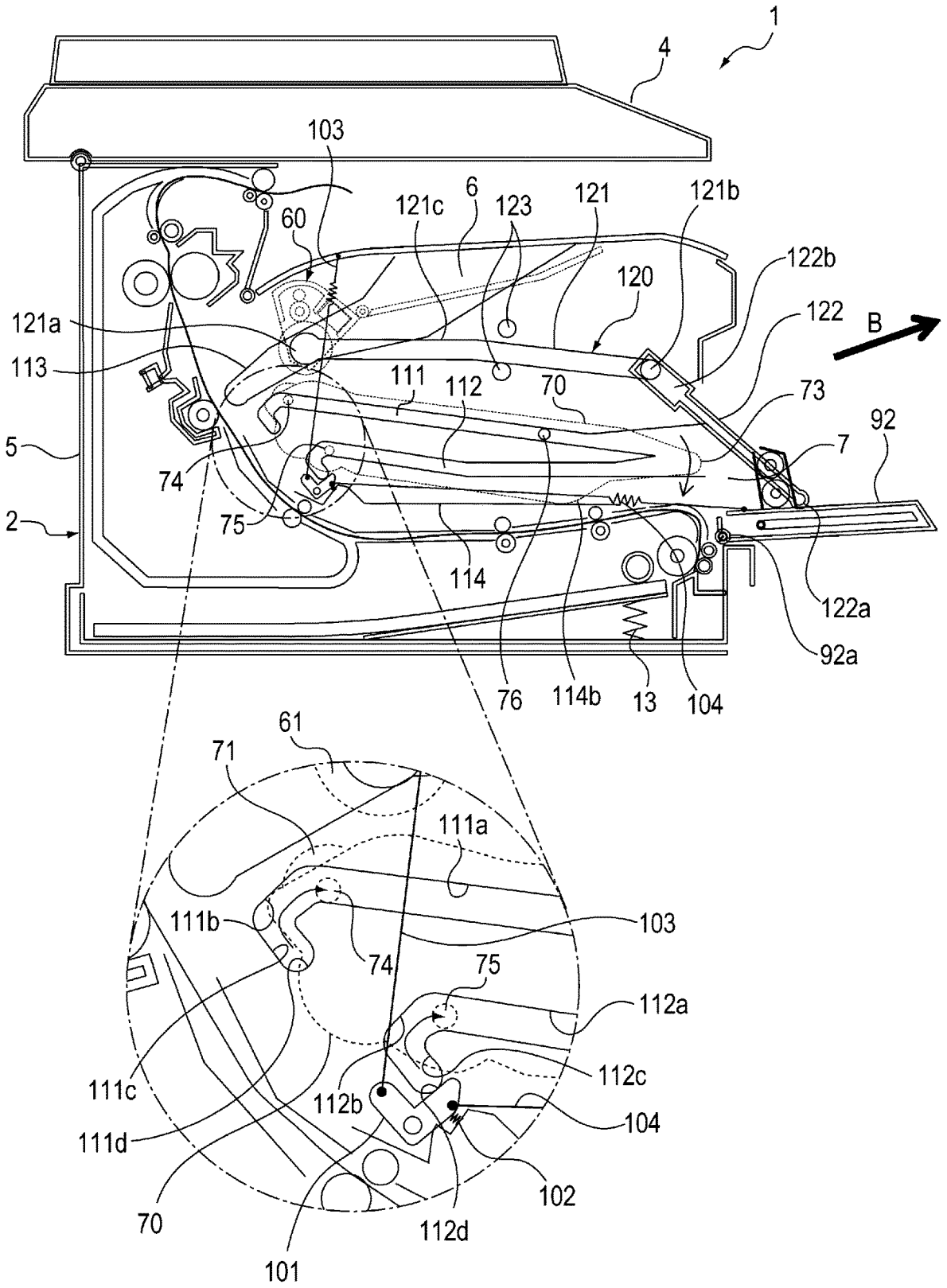
FIG. 8 is a sectional view showing a structure of the mounting portion for the developing cartridge in a state of the developing cartridge during dismounting in the open state of the front door.
Figure 9:
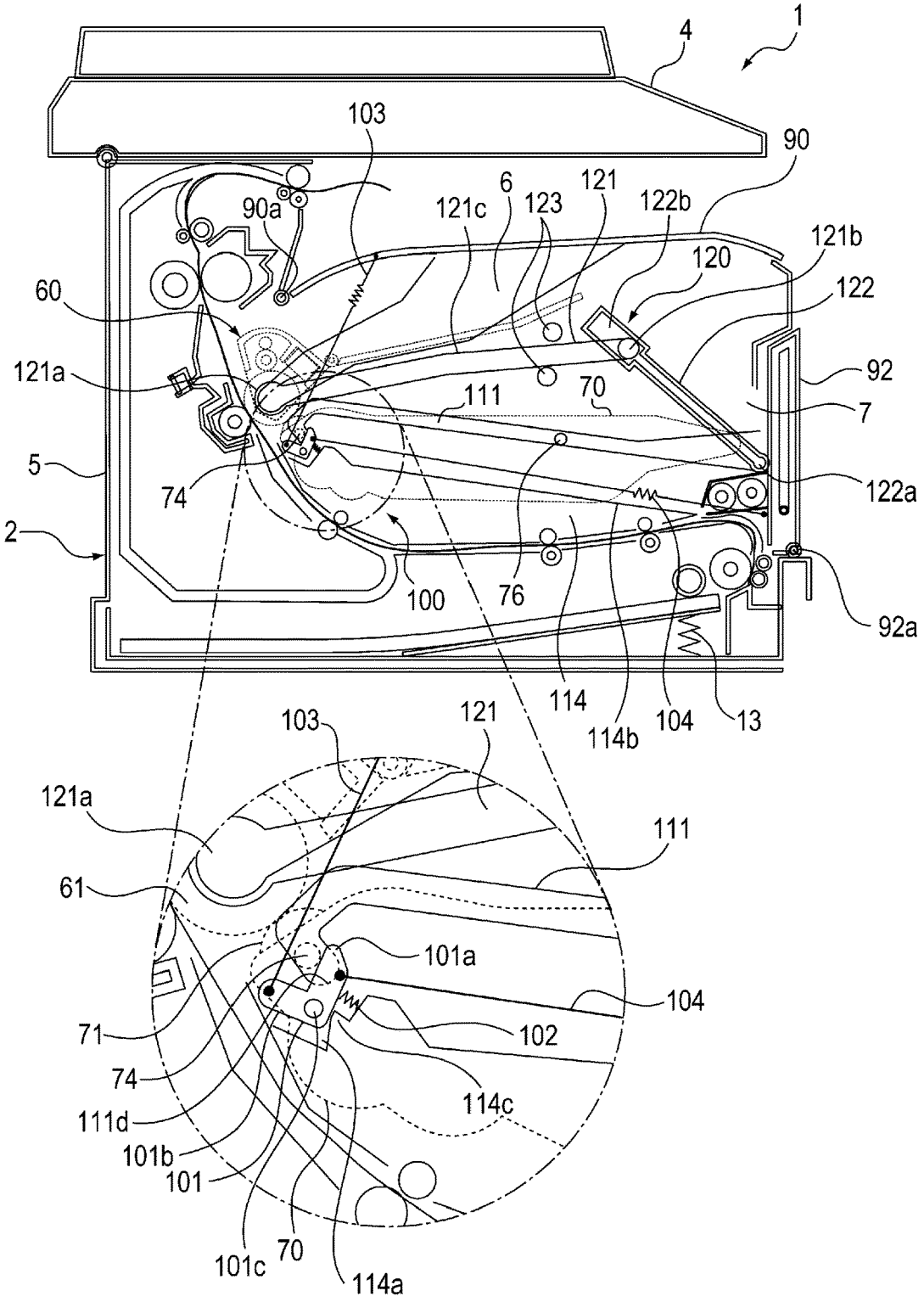
FIG. 9 is a sectional view showing a structure of the mounting portion for the developing cartridge in a first modified embodiment.
Figure 10:
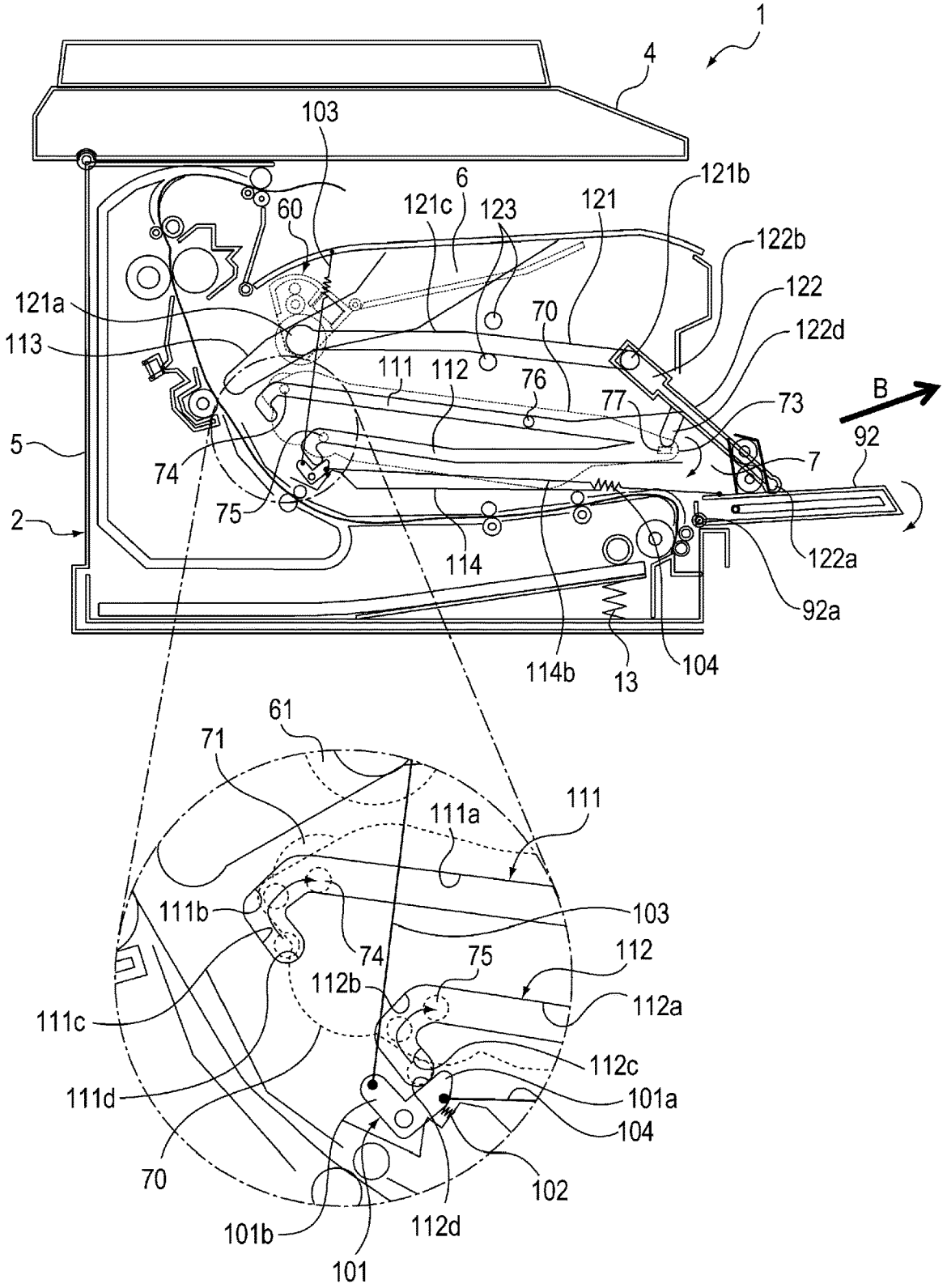
FIG. 10 is a sectional view showing a structure of the mounting portion for the developing cartridge in a second modified embodiment.

Next, the mounting and dismounting operation of the developing cartridge 70 mounted in the apparatus main assembly 2 will be described using FIGS. 6 to 10. FIG. 6 is a sectional view showing structure of a mounting portion for the developing cartridge 70 when the front door 92 is in an intermediate state of the opening and closing operation. FIG. 7 is a sectional view showing a structure of the mounting portion for the developing cartridge 70 when the front door 92 is in an open state. FIG. 8 is a sectional view showing a structure of the mounting portion for the developing cartridge 70 when the developing cartridge 70 is in an intermediate state of a dismounting operation. FIG. 9 is a sectional view showing a structure of the mounting portion for the developing cartridge 70 in a first modified embodiment. FIG. 10 is a sectional view showing a structure of the mounting portion for the developing cartridge 70 in a second modified embodiment.

<Dismounting Operation of Developing Cartridge>

A dismounting operation of the developing cartridge 70 will be described. In order to have access to the developing cartridge 70, as shown in FIG. 6, the front door 92 is rotated about the front door shaft 92*a* from the closed position toward the intermediate position in the clockwise direction of FIG. 6. The front door 92 rotates about the front door shaft 92*a* from the closed position shown in FIG. 6 in the clockwise direction of FIG. 6, so that as shown in FIG. 6, the front door 92 moves to the intermediate position where the front door 92 is inclined by about 45 degrees. The front door 92 rotates in the clockwise direction of FIG. 6. By this, the pressing portion 101*a* of the developing pressing member 101 is pulled toward the front side of the apparatus main assembly 2 (i.e., the right side of FIG. 6) through the second pressing releasing member 104 connected to the front door 92.

As shown in FIG. 6, when the front door 92 is rotated to the open state, the tensile force F1 of the second pressing releasing member 104 is larger than the pressing force F2 of the pressing spring 102. For this reason, the developing pressing member 101 rotates about the developing pressing shaft 101*c* in the clockwise direction of FIG. 6 against the pressing force F2 of the pressing spring 102, so that the pressing portion 101*a* contacts a pressing member abutment portion 114*c*. By this, the developing pressing member 101 moves to a pressing releasing position of the developing cartridge 70.

When the developing cartridge 70 is released from the developing pressing member 101, by the self-weight of the developing cartridge 70, the first developing projection 74 is guided to the restricting portion 111*d* and the second developing projection 75 is guided to the restricting portion 112*d*. By this, the developing cartridge 70 moves forward and downward with respect to the apparatus main assembly 2.

By movement of the developing cartridge 70, the developing roller 71 is separated from the photosensitive drum 61. Further, by opening the front door 92, in the link unit 120, the second link arm 122 connected to the front door 92 rotatably about the second arm supporting point 122*a* is pulled forward and downward with respect to the apparatus main assembly 2.

By movement of the second link arm 122 in the forward and downward direction of the apparatus main assembly 2, the second elongated hole 122*b* means force with respect to the apparatus main assembly 2 and receives the first arm projection 121*b* at an upper end (edge) thereof on the rear side with respect to the apparatus main assembly 2. At this time, the first link arm 121 does not move, and therefore, the drum cartridge 60 is kept at the image forming position of the apparatus main assembly 2.

Next, the front door 92 is rotated about the front door shaft 92*a* from the intermediate position shown in FIG. 6 toward the open position shown in FIG. 7 in the clockwise direction of FIG. 7. The front door 92 rotates about the front door shaft 92*a* from the intermediate position shown in FIG. 6 in the clockwise direction of FIG. 6, so that as shown in FIG. 7, the front door 92 moves to the open position where the front door 92 is inclined by substantially 90 degrees.

At this time, the pressing portion 101*a* contacts the pressing member abutment portion 114*a* of the pressing member accommodating portion 114*a*. For this reason, the second pressing releasing member 104 elongates. Further, by opening the front door 92, the second link arm 122 is further pulled forward and downward with respect to the apparatus main assembly 2. Then, the upper end (edge) of the second arm elongated hole 122*b* on the rear side of the apparatus main assembly 2 contacts the first arm projection 121*b*. Then, the first link arm 121 is guided by the guiding projection 123 and is pulled forward with respect to the apparatus main assembly 2.

By pulling the first link arm 121 forward with respect to the apparatus main assembly 2, the photosensitive drum 61 held by the drum holding portion 121*a* is guided by the drum guide 113 and is moved forward and upward with respect to the apparatus main assembly 2. By this, the drum cartridge 60 moves to an image formation releasing (eliminating) position.

Thus, the photosensitive drum 61 is retracted from a locus of the developing roller 71 passing through the first developing guide 111 during the mounting and dismounting operation of the developing cartridge 70.

Finally, the user grips the developing cartridge 70 and dismounts the developing cartridge 70 from the apparatus main assembly 2. The dismounting operation is performed through the following three (first to third) stages. As the first stage, as shown in FIG. 8, the user grips the developing gripping portion 73 of the developing cartridge 70 and presses the developing cartridge 70 in a downward direction. By a pressing force of the developing gripping portion 73 in the downward direction, the developing cartridge 70 is rotated about a third developing projection 76 as a fulcrum in the clockwise direction of FIG. 8. By this rotating operation, the first developing projection 74 of the developing cartridge 70 is guided from the restricting portion 111*d* to the guiding portion 111*c* of the first developing guide 111. Further, the second developing projection 75 is guided from the restricting portion 112*d* to the guiding portion 112*c* of the second developing guide 112. By this, the rear side of the developing cartridge 70 in the apparatus main assembly 2 moves upward.

At this time, the end portion of the developing cartridge 70 on the rear side of the apparatus main assembly 2 passes through a space occupied by the photosensitive drum 61 when the drum cartridge 60 is disposed at the image forming position. As the second stage, the first developing projection 74 of the developing cartridge 70 is guided from the guiding portion 111*c* to the guiding portion 111*b* of the first developing guide 111. Further, the second developing projection 75 of the developing cartridge 70 is guided from the guiding portion 112*c* to the guiding portion 112*b* of the second pressing guide 112. By this, the developing cartridge 70 moves forward and upward with respect to the apparatus main assembly 2.

As the third stage, the first developing projection 74 of the developing cartridge 70 is guided from the guiding portion 111*b* to the guiding portion 111*a* of the first developing guide 111. Further, the second developing projection 75 of the developing cartridge 70 is guided from the guiding portion 112*b* to the guiding portion 112*a* of the second developing guide 112. By this, the developing cartridge 70 moves forward and downward with respect to the apparatus main assembly 2. Through the above-described three stages, the developing cartridge 70 passes below the laser scanner 80 and is dismounted through the second opening 7. By this, the dismounting operation of the developing cartridge 70 from the apparatus main assembly 2 is completed.

<Mounting Operation of Developing Cartridge>

Next, the mounting operation of the developing cartridge 70 will be described. In order to mount the developing cartridge 70 in the apparatus main assembly 2, the front door 92 and the developing cartridge 70 are operated in a procedure which is the reverse of the above-described dismounting operation (procedure). First, the user opens the front door 92 and grips the developing gripping portion 73 of the developing cartridge 70, and inserts the developing cartridge 70 into the apparatus main assembly 2 through the second opening 7. Further, the user inserts the first developing projection 74 into the guiding portion 111*a* of the first developing guide 111, and inserts the second developing projection 75 into the guiding portion 112*a* of the second developing guide 112.

The first developing projection 74 of the developing cartridge 70 is guided to the guiding portion 111*a* of the first developing guide 111. Further, the second developing projection 75 of the developing cartridge 70 is guided to the guiding portion 112*a* of the second developing guide 112. By this, the developing cartridge 70 is inserted rearward and upward with respect to the apparatus main assembly 2 along the guiding portions 111*a* and 112*a*. When the developing cartridge 70 is inserted rearward and upward with respect to the apparatus main assembly 2 in a predetermined amount, the third developing projection 76 of the developing cartridge 70 is guided to the guiding portion 111*a*.

Thereafter, the first developing projection 74 of the developing cartridge 70 is guided to the guiding portion 111*b* of the first developing guide 111. Further, the second developing projection 75 of the developing cartridge 70 is guided to the guiding portion 112*b* of the second developing guide 112. By this, the developing cartridge 70 is inserted rearward and downward into the apparatus main assembly 2. At this time, the first developing projection 74 of the developing cartridge 70 contacts the end portion of the first developing guide 111 on the rear side of the apparatus main assembly 2, and the second developing projection 75 of the developing cartridge 70 contacts the end portion of the second developing guide 112 on the rear side of the apparatus main assembly 2. By this, movement of the developing cartridge 70 toward the rear side of the apparatus main assembly 2 is restricted.

Then, as shown in FIG. 7, by the self-weight of the developing cartridge 70, the first developing projection 74 is guided from the guiding portion 111*c* to the guiding portion 111*d* of the first developing guide 111. Further, the second developing projection 75 is guided from the guiding portion 112*c* to the guiding portion 112*d* of the second developing guide 112. By this, the developing cartridge 70 moves forward and downward with respect to the apparatus main assembly 2. By the above-described operation, the first developing projection 74 is held by the restricting portion 111*d*, and the second developing projection 75 is held by the restricting portion 112*d*.

Next, the front door 92 is rotated from the open position shown in FIG. 7 toward the closed position shown in FIG. 5. First, the second link arm 122 of the link unit 120 moves rearward and upward with respect to the apparatus main assembly 2 as the front door 92 closes. The second arm elongated hole 122*b* of the second link arm 122 moves rearward and upward with respect to the apparatus main assembly 2, so that the first link arm 121 moves toward the rear side of the apparatus main assembly 2. By this, the drum cartridge 60 held by the drum holding portion 121 is guided by the drum guide 113 and is moved to the image forming position.

At this time, the second pressing releasing member 104 gradually contracts and therefore, the tensile force F1 applied to the developing pressing member 101 by the second pressing releasing member 104 gradually becomes small. The tensile force F1 by the second pressing releasing member 104 gradually becomes small, so that the developing pressing member 101 rotates in the counter clockwise direction of FIG. 5 with the developing pressing shaft 101*c* as a fulcrum by the pressing force F2.

The developing pressing member 101 rotates in the counter clockwise direction of FIG. 5, so that the pressing portion 101*a* contacts the second developing projection 75. By this, the second developing projection 75 is pressed rearward and upward with respect to the apparatus main assembly 2, so that the developing roller 71 of the developing cartridge 70 contacts the photosensitive drum 61. At this time, the developing pressing member 101 is in the pressing position shown in FIG. 5. By this, the mounting operation of the developing cartridge 70 into the apparatus main assembly 2 is completed.

The drum cartridge 60 and the developing cartridge 70 are mounted and dismounted through the first opening 6 and the second opening 7, respectively, which are different from each other. It is possible to release pressing of the developing pressing member 101 pressing the developing cartridge 70 so that the developing roller 71 as the developer carrying member contacts the photosensitive drum 61 as the image bearing member in interrelation with the opening and closing operations of the front door 92 and the discharge tray 90 which are used as a plurality of openable members. By this, the developing roller 71 and the photosensitive drum 61 are not rubbed with each other and are not deteriorated not only when the developing cartridge 70 is mounted and dismounted but also when the drum cartridge 60 is mounted and dismounted. Different from JP-A 2016-138994, there is no need to open not only the discharge tray 90 but also the front door 92 when the drum cartridge 60 is dismounted.

First Modified Embodiment

In the above-described embodiment, the first developing projection 74, the second developing projection 75 and the third developing projection 76 which are three projections provided on the developing cartridge 70 are guided by the first developing guide 111 and the second developing guide 112. By this, the developing cartridge 70 was mounted in the apparatus main assembly 2. As another example, a constitution in which as in this (first) modified embodiment shown in FIG. 9, the second developing projection 75 provided on the developing cartridge 70 and the second developing guide 112 provided on the apparatus main assembly 2 side are omitted may also be employed.

In this constitution, the first developing projection 74 and the third developing projection 76 which are provided on the developing cartridge 70 shown in FIG. 9 are guided by the first developing guide 111 provided on the apparatus main assembly 2 side, so that the developing cartridge 70 is mounted in the apparatus main assembly 2.

Further, as another constitution, a constitution in which the third developing projection 76 provided on the developing cartridge 70 shown in FIG. 5 is omitted and in which the developing cartridge 70 is held only by the first developing projection 74 and the second developing projection 75 which are provided on the developing cartridge 70 may also be employed. Further, as another constitution, a constitution in which the first developing projection 74 provided on the developing cartridge 70 shown in FIG. 5 is omitted and in which the developing cartridge 70 is held only by the second developing projection 75 and the third developing projection 76 which are provided on the developing cartridge 70 may also be employed.

Second Modified Embodiment

In the above-described embodiment, as shown in FIG. 8, a type in which after the user rotates the front door 92 to the open state, the user presses the developing gripping portion 73 downward and thus the developing cartridge 70 is dismounted was used. As another constitution, a constitution in which as in this (second) modified embodiment shown in FIG. 10, a developing pressing portion 122*d* provided on the second link arm 122 presses down the developing cartridge 70 may also be employed.

In this constitution, the second link arm 122 is provided with the developing pressing portion 122*d*, and the developing cartridge 70 is provided with a fourth developing projection 77 on the front side of the apparatus main assembly 2. As shown in FIG. 10, when the front door 92 is rotated to the open state, the developing pressing portion 122*d* of the second link arm 122 moving in interrelation with the front door 92 contacts the fourth developing projection 77 of the developing cartridge 70, so that the front side of the developing cartridge 70 in the apparatus main assembly 2 is pressed downward.

The developing cartridge 70 is rotated in the clockwise direction of FIG. 10 with the third developing projection 76 as a fulcrum by a downward pressing force of the developing gripping portion 73. By this rotation operation, the first developing projection 74 of the developing cartridge 70 is successively guided from the restricting portion 111*d* to the guiding portion 111*b* via the guiding portion 111*c* of the first developing guide 111. Further, the second developing projection 75 of the developing cartridge 70 is successively guided from the restricting portion 112*d* to the guiding portion 112*b* via the guiding portion 112*c* of the second developing guide 112. By this, the rear side of the developing cartridge 70 in the apparatus main assembly 2 is moved upward.

Thereafter, the user grips the developing gripping portion 73 and pulls the developing cartridge 70 toward the front side of the apparatus main assembly 2. By this, the first developing projection 74 of the developing cartridge 70 is guided from the guiding portion 111*b* to the guiding portion 111*a* of the first developing guide 111. Further, the second developing projection 75 is guided from the guiding portion 112*b* to the guiding portion 112*a* of the second developing guide 112. By this, the developing cartridge 70 passes through the second open 7 and is dismounted from the apparatus main assembly 2.

<Mounting and Dismounting Operation of Drum Cartridge>

Figure 11:
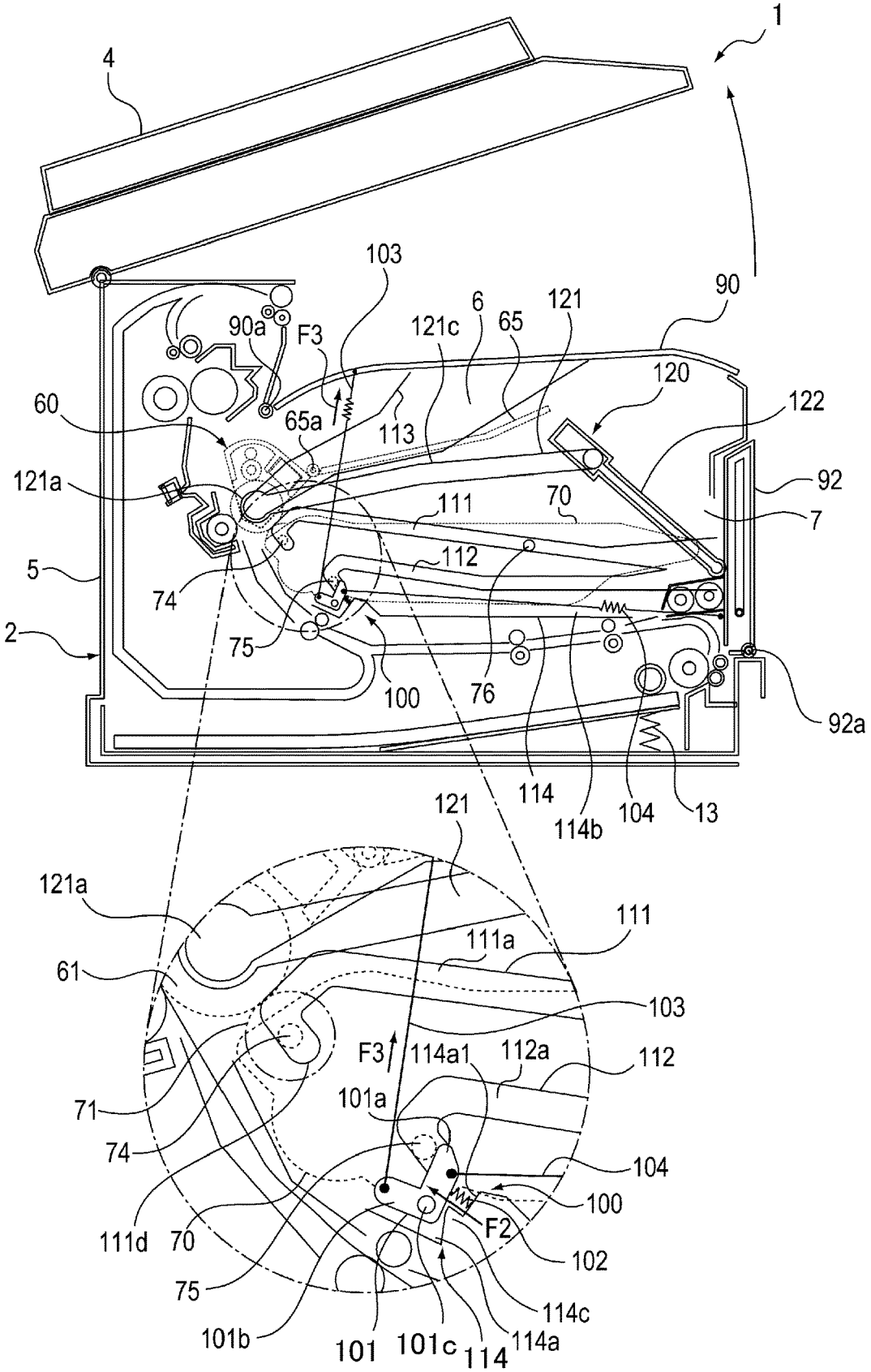
FIG. 11 is a sectional view showing a structure of the mounting portion for the developing cartridge when the original reading portion is in a closed state and the discharge tray is in a closed state.

Next, the mounting and dismounting operation of the drum cartridge 60 mounted in the apparatus main assembly 2 will be described using FIGS. 11 and 12. FIG. 11 is a sectional view showing a structure of a mounting portion for the developing cartridge 70 when the original reading portion 4 is in the open state and the discharge tray 90 is in the closed state. FIG. 12 is a sectional view showing a structure of the mounting portion for the developing cartridge 70 when the original reading portion 4 is in the open state and the discharge tray 90 is in the open state.

<Dismounting Operation of Drum Cartridge>

First, the dismounting operation of the drum cartridge 60 will be described. The original reading portion 4 is moved upward from the closed position to the open position as shown in FIG. 11. In the closed state of the discharge tray 90, the second developing projection 75 of the developing cartridge 70 is moved rearward and upward with respect to the apparatus main assembly 2 by being pressed by the pressing portion 101*a* of the developing pressing member 101 pressed by the pressing spring 102, so that the developing roller 71 is contacted to the photosensitive drum 61.

Next, as shown in FIG. 12, the discharge tray 90 is rotated about the discharge tray shaft 90*a* in the counter clockwise direction of FIG. 12 and is moved from the closed position shown in FIG. 11 to the open position shown in FIG. 12. The discharge tray 90 is rotated in the counter clockwise direction to the open position shown in FIG. 12, whereby the non-pressing portion 101*b* of the developing pressing member 101 is pulled upward via the first pressing releasing member 103 connected to the discharge tray 90.

A pressing force F3 of the first pressing releasing member 103 is made larger than the pressing force F2 of the pressing spring 102 by rotating the discharge tray 90 to the open state (position) shown in FIG. 12. For this reason, the first pressing releasing member 103 rotates the first developing pressing member 101 about the developing pressing shaft 101*c* in the clockwise direction of FIG. 12 against the pressing force F2 of the pressing spring 102, so that the pressing portion 101*a* contacts the pressing member abutment portion 114*c*. By this, the developing pressing member 101 moves to the pressing releasing position shown in FIG. 12.

That is, the first pressing releasing member 103 pulls the non-pressing portion 101*b* of the developing pressing member 101 in interrelation with movement of the discharge tray 90 from the first closed position shown in FIG. 5 to the first open position shown in FIG. 12. By this, the developing pressing member 101 is rotated about the developing pressing shaft 101*c* in a non-pressing direction (clockwise direction of FIG. 5) against the pressing force F2 of the pressing spring 102 as the urging member. As a result, the second developing projection 75 of the developing cartridge 70 is released from the pressing portion 101*a* of the developing pressing member 101.

At this time, when the discharge tray 90 as the first openable member is in the first closed position shown in FIG. 5, the tensile force F3 by the tension spring of the first pressing releasing member 103 is smaller than the pressing force F2 of the pressing spring 102 as the urging member. By this, the pressing portion 101*a* of the developing pressing member 101 pressed by the pressing spring 102 presses the second developing projection 75 of the developing cartridge 70, so that the developing roller 71 is contacted to the photosensitive drum 61.

Further, when the discharge tray 90 as the first openable member is in the first open position shown in FIG. 12, the tensile force F3 of the first pressing releasing member 103 is larger than the pressing force F2 of the pressing spring 102 as the urging member. By this, it is possible to release (eliminate) the second developing projection 75 of the developing cartridge 70 from the pressing portion 101*a* of the developing pressing member 101 against the pressing force F2 of the pressing spring 102. As a result, the developing roller 71 can be separated from the photosensitive drum 61.

The second developing projection 75 of the developing cartridge 70 is released from the developing pressing member 101. Then, by the self-weight of the developing cartridge 70, the first developing projection 74 of the developing cartridge 70 is guided by the restricting portion 111*d*. Further, the second developing projection 75 of the developing cartridge 70 is guided by the restricting portion 112*d*. By this, the developing cartridge 70 is moved forward and downward with respect to the apparatus main assembly 2. By movement of the developing cartridge 70, the developing roller 71 is separated from the photosensitive drum 61.

Finally, the user grips the drum gripping portion 65 of the drum cartridge 60 and dismounts the drum cartridge 60 from the apparatus main assembly 2. When the user intends to pull out the drum cartridge 60 in the upward direction by gripping the drum gripping portion 65, the drum gripping portion 65 rotates in the counter clockwise direction of FIG. 12 with a shaft 65*a* as a fulcrum. The pressing member gripping portion 65 rotates in the counter clockwise direction of FIG. 12 and is in an attitude substantially parallel to a pulling-out direction of the developing cartridge 60 indicated as an arrow A direction of FIG. 12, so that the user can pull out the drum cartridge 60 with a smaller force.

The user pulls out the drum cartridge 60 in the arrow A direction of FIG. 12 by gripping the drum gripping portion 65, so that the developing cartridge 60 is guided by the drum guide 113 shown in FIG. 12 and is dismounted through the first opening 6. By this, the dismounting operation of the drum cartridge 60 from the apparatus main assembly 2 is completed.

<Mounting Operation of Drum Cartridge>

Further, in the case where the drum cartridge 60 is mounted in the apparatus main assembly 2, in the procedure which is the reverse of the above-described dismounting operation (procedure), the apparatus main assembly 2 and the drum cartridge 60 are operated. First, as shown in FIG. 12, the original reading portion 4 and the discharge tray 90 are placed in the open positions relative to the apparatus main assembly 2. In that state, the user grips the drum gripping portion 65 of the drum cartridge 60 and inserts drum end portions provided at longitudinal end portions of the photosensitive drum 61 so as to engage the drum end portions in the drum guide 113.

The drum end portions of the drum cartridge 60 are guided by the drum guide 113 and are inserted rearward and downward with respect to the apparatus main assembly 2. The drum end portions of the photosensitive drum 61 abut against rear end portions of the drum guide 113, so that the drum cartridge 60 is mounted in the image forming position.

The user confirms mounting of the developing cartridge 60 and thereafter releases the drum gripping portion 65. By this, the drum gripping portion 65 is rotated in the clockwise direction of FIG. 11 with the shaft 65*a* as a fulcrum by the self-weight thereof, and thus is accommodated in the apparatus main assembly 2.

Then, the discharge tray 90 is rotated from the open position shown in FIG. 12 toward the closed position shown in FIG. 11.

At this time, the spring portion of the first pressing releasing member 104 gradually contracts and therefore, the tensile force F3 applied to the developing pressing member 101 by the first pressing releasing member 103 gradually becomes small. The tensile force F3 by the first pressing releasing member 103 gradually becomes small, so that the developing pressing member 101 rotates in the counter clockwise direction of FIG. 11 with the developing pressing shaft 101*c* as a fulcrum by the pressing force F2.

The developing pressing member 101 rotates in the counter clockwise direction of FIG. 11, so that the pressing portion 101*a* contacts the second developing projection 75 of the developing cartridge 70. By this, the second developing projection 75 is pressed rearward and upward with respect to the apparatus main assembly 2, so that the developing roller 71 of the developing cartridge 70 contacts the photosensitive drum 61. At this time, the developing pressing member 101 is in the pressing position shown in FIG. 11. By this, the mounting operation of the drum cartridge 60 into the apparatus main assembly 2 is completed.

<Functional Effects>

(1) The developing cartridge 70 is guided by the first developing guide 111 and the second developing guide 112 which are provided on the apparatus main assembly 2 side. By this, the developing cartridge 70 is moved between a dismountable position where the developing cartridge 70 is mountable in and dismountable from the apparatus main assembly 2 and a contact position where the developing roller 71 contacts the photosensitive drum 61.

Further, as regards the developing cartridge 70, the first developing projection 74 and the second developing projection 75 of the developing cartridge 70 are guided by the restricting portion 111*d* of the first developing guide 111 and the restricting portion 112*d* of the second developing guide 112, respectively. By this, the developing cartridge 70 is moved between the contact position where the developing roller 71 contacts the photosensitive drum 61 and a separated position located below the contact position.

Further, the second developing projection 75 of the developing cartridge 70 is pressed by the pressing portion 101*a* of the developing pressing member 101 rotating about the developing pressing shaft 101*c* in the counter clockwise direction. By this, the developing cartridge 70 is pressed toward (rearward and upward with respect to the apparatus main assembly 2) the direction from the developing roller 71 toward the photosensitive drum.

The developing pressing member 101 is disposed forward and downward with respect to the apparatus main assembly 2 than the developing cartridge 70, the restricting portion 111*d* of the first developing guide 111 and the restricting portion 112*d* of the second developing guide 112. By this, the developing cartridge 70 can be mounted in the apparatus main assembly without being hindered by the developing pressing member 101.

Further, the case where the pressing force of the developing pressing member 101 by an elongation force of the developing spring 102 is weak and the case where a large external force is applied to the developing cartridge 70 by drop, vibration or the like will be considered. At this time, the first developing projection 74 and the second developing projection 75 which are provided on the developing cartridge 70 are restricted by the restricting portion 111*d* of the first developing guide 111 and the restricting portion 112*d* of the second developing guide 112, respectively. By this, it is possible to suppress falling of the developing cartridge 70 from the apparatus main assembly 2.

(2) The guiding portion 111*c* connected to the restricting portion 111*d* of the first developing guide 111 and the guiding portion 112*c* connected to the restricting portion 112*d* of the second developing guide 112 will be considered. The guiding portion 111*c* and the guiding portion 112*c* extend in parallel to a rectilinear line 16 connecting a rotation center 71*a* of the developing roller 71 of the developing cartridge 70 and a rotation center 61*a* of the photosensitive drum 61 of the developing cartridge 60.

Further, the second developing projection 75 of the developing cartridge 70 is pressed by the pressing portion 101*a* of the developing pressing member 101 rotating about the developing pressing shaft 101*c* in the counter clockwise direction of FIG. 11. Further, the first developing projection 74 is guided by the guiding portion 111*c* of the first developing guide 111 and is moved along the guiding portion 111*c*. By this, the developing roller 71 provided in the developing cartridge 70 can be contacted to the photosensitive drum 61 provided in the drum cartridge 60.

(3) The first developing projection 74 of the developing cartridge 70 is guided rearward and upward with respect to the apparatus main assembly 2 by the guiding portion 111*a* of the first developing guide 111. Thereafter, the first developing projection 74 is guided rearward and downward with respect to the apparatus main assembly 2 by the guiding portion 111*b*. Thereafter, the first developing projection 74 is guided to the restricting portion 111*d* by the guiding portion 111*c*. By this, the direction of the developing cartridge is converted (changed), so that the developing cartridge 70 can be smoothly mounted in the apparatus main assembly 2.

(4) The second developing projection 75 of the developing cartridge 70 is pressed by the pressing portion 101*a* of the developing pressing member 101 rotating about the developing pressing shaft 101*c* in the counter clockwise direction of FIG. 5. At this time, the guiding portion 111*c* of the first developing guide 111 shown in FIG. 4 is closer to the photosensitive drum 61 than the guiding portion 111*a* and the guiding portion 111*c* are. By this, the second developing projection 75 of the developing cartridge 70 guided to the restricting portion 111*d* of the first developing guide 111 shown in FIG. 4 can be pressed toward the guiding portion 111*b*. As a result, the developing roller 71 can be contacted to the photosensitive drum 61.

(5) By utilizing the first developing guide 111 and the second developing guide which are disposed below the laser scanner 80 shown in FIG. 4, the developing cartridge 70 is passed below the laser scanner 80 and thus can be mounted in the apparatus main assembly 2. For that reason, in a space below the laser scanner 80, the developing cartridge 70 can be disposed, so that the toner accommodating portion with a large volume can be accommodated. Further, the developing roller 71 is contacted to the photosensitive drum 61 from the forward and downward side of the apparatus main assembly 2, so that it is possible to suppress falling of the toner carried on the developing roller 71 and thus to suppress deposition of the toner on the photosensitive drum 61.

(6) The front door 92 is opened, and the developing cartridge 70 can be mounted and dismounted through the second opening 7 of the apparatus main assembly 2.

(7) The second pressing releasing member 104 pulls forward the pressing portion 101*a* of the developing pressing member 101 with respect to the apparatus main assembly 2 by the opening operation of the front door 92. By this, the developing pressing member 101 is moved from the developing position shown in FIG. 5 to the pressing releasing position shown in FIG. 7 against the pressing force F2 of the pressing spring 102. By this, simplification of the mounting and dismounting operation of the developing cartridge 70 relative to the apparatus main assembly 2 can be realized.

(8) The drum cartridge 70 supporting the photosensitive drum 61 is guided by the drum guide 113 at the drum end portions provided at the longitudinal end portions of the photosensitive drum 61. By this, the photosensitive drum 61 can be moved between the image forming position and the non-image forming position. For that reason, the photosensitive drum 61 is separated from the developing roller 71, and thereafter the developing cartridge 70 can be dismounted from the apparatus main assembly 2. By this, deterioration of the photosensitive drum 61 and the developing roller 71 due to the rubbing therebetween can be suppressed.

(9) The link unit 120 is capable of moving the photosensitive drum 61, held by the drum holding portion 121*a* via the first link arm 121 and the second link arm 122, from the image forming position to the non-image forming position by the opening and closing operation of the front door 92. By this, simplification of the mounting and dismounting of the developing cartridge 70 relative to the apparatus main assembly 2 can be realized.

(10) The front door 92 is rotated from the closed position shown in FIG. 5 to the intermediate position shown in FIG. 6. By this, the second pressing releasing member 104 rotates the developing pressing member 101 from the pressing position shown in FIG. 5 to the pressing releasing position shown in FIG. 6. Further, the front door 92 is rotated from the intermediate position shown in FIG. 6 to the open position shown in FIG. 7. By this, the link unit 120 moves the photosensitive drum 61 of the drum cartridge 60 from the image forming position shown in FIG. 6 to the image formation releasing position shown in FIG. 7.

The second pressing releasing member 104 and the link unit 120 are operated in the named order by a series of operations in which the front door 92 is rotated from the closed position shown in FIG. 5 to the open position shown in FIG. 7, so that the developing pressing member 101 and the photosensitive drum 61 can be operated without causing interference therebetween. By this, further simplification of the mounting and dismounting of the developing cartridge 70 relative to the apparatus main assembly 2 can be realized.

(11) The discharge tray 90 is rotated from the closed position shown in FIG. 11 to the open position shown in FIG. 12. By this, the first pressing releasing member 103 rotates the developing pressing member 101 from the pressing position shown in FIG. 11 to the pressing releasing position shown in FIG. 12. The second developing projection 75 of the developing cartridge 70 is released from the pressing portion 101*a* of the developing pressing member 101, so that the developing cartridge 70 is moved from the contact position shown in FIG. 11 where the photosensitive drum 61 and the developing roller 71 are in contact with each other to the separated position shown in FIG. 12 where the photosensitive drum 61 and the developing roller 71 are separated.

In a state in which the developing roller 71 is separated from the photosensitive drum 61, the drum cartridge 60 can be dismounted from the apparatus main assembly 2. By this, in the mounting and dismounting operation of the drum cartridge 60, deterioration of the photosensitive drum 61 and the developing roller 71 due to rubbing therebetween can be suppressed.

(12) The drum cartridge 60 can be mounted and dismounted from the apparatus main assembly 2 through the first opening 6 different from the first opening 7 for permitting mounting and dismounting of the developing cartridge 70. By this, the photosensitive drum 61 can be disposed above the developing roller 71. By this, it is possible to suppress falling of the toner carried on the developing roller 71 and thus to suppress deposition of the toner on the photosensitive drum 61. Further, the developing cartridge 70 and the drum cartridge 60 can be independently exchanged.

(13) The drum cartridge 60 is passed above the laser scanner 80 and can be mounted in and dismounted from the apparatus main assembly 2. The case where the pressing force F2 of the pressing spring 102 pressing the developing pressing member 101 contacting the second developing projection 75 of the developing cartridge 70 and the case where a large external force is applied to the developing cartridge 70 due to drop, vibration or the like will be considered. The first developing projection 74 and the second pressing projection 75 which are provided on the developing cartridge 70 are restricted by the restricting portion 111*d* of the first developing guide 111 and the restricting portion 112*d* of the second developing guide 112, respectively, and therefore, drop of the developing cartridge 70 can be suppressed.

OTHER EMBODIMENTS

In the above-described embodiments, the laser scanner 80 was used as an example of the exposure unit. As another example, an LED (light emitting diode) unit can also be applied as the exposure unit.

Further, in the above-described embodiments, a development type in which the photosensitive drum 61 and the developing roller 71 are in contact with each other was described. In addition, the embodiments are also applicable to a non-contact development type in which a gap is formed between the photosensitive drum 61 and the developing roller 71. That is, when the drum cartridge 60 and the developing cartridge 70 which are mounted in the apparatus main assembly 2 are in the image forming positions, the developing roller 71 as the developer carrying member and the photosensitive drum 61 as the image bearing member may also be in the non-contact state. Further, in the embodiments described above, an example of the image forming apparatus 1 including the original reading portion 4 was described. In addition, the embodiments are also applicable to an image forming apparatus including no original reading portion 4.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-087733 filed on May 7, 2019, which is hereby incorporated by reference herein in its entirety.

What is claimed is:

1. An image forming apparatus comprising:

a drum cartridge including a photosensitive drum;

a developing cartridge including a developing roller configured to supply toner to said photosensitive drum; and a main assembly configured so that said drum cartridge and said developing cartridge are independently mountable in and dismountable from said main assembly, said main assembly including, a first opening through which said drum cartridge passes when said drum cartridge is mounted in and dismounted from said main assembly, a second opening through which said developing cartridge passes when said developing cartridge is mounted in and dismounted from said main assembly, a first openable member configured to move between a first closed position where said first opening is closed and a first open position where said first opening is open, a second openable member configured to move between a second closed position where said second opening is closed and a second open position where said second opening is open, a pressing member configured to press said developing cartridge so that said developing roller contacts said photosensitive drum, a first pressing releasing member configured to release said developing cartridge from said pressing member in a state in which said second openable member is in the second closed position, in interrelation with movement of said first openable member from the first closed position to the first open position, and a second pressing releasing member configured to release said developing cartridge from said pressing member in interrelation of movement of said second openable member from the second closed position to the second open position.

2. An image forming apparatus according to claim 1, wherein said second pressing releasing member releases said developing cartridge from said pressing member in a state in which said first openable member is in the first closed position, in interrelation with the movement of said second openable member from the second closed position to the second open position.

3. An image forming apparatus according to claim 1, further comprising an urging member, wherein said pressing member is movable between a pressing position where said pressing member presses said developing cartridge so that said developing roller contacts said photosensitive drum and a pressing releasing position where said developing cartridge is released, wherein said urging member urges said developing cartridge in a direction in which said pressing member from the pressing releasing position to the pressing position, wherein said first pressing releasing member connects said first openable member and said pressing member so that said pressing member moves from the pressing position to the pressing releasing position in interrelation with the movement of said first openable member from the first closed position to the first open position, and wherein said second pressing releasing member connects said second openable member and said pressing member so that said pressing member moves from the pressing position to the pressing releasing position in interrelation with the movement of said second openable member from the second closed position to the second open position.

* * * * *